US006943767B2

(12) United States Patent
Abe et al.

(10) Patent No.: US 6,943,767 B2
(45) Date of Patent: Sep. 13, 2005

(54) IMAGE DISPLAY DEVICE AND METHOD OF SUPPLYING WRITING ELECTRIC POTENTIAL TO AN IMAGE DISPLAY DEVICE

(75) Inventors: Kazuhiro Abe, Yamato (JP); Eisuke Kanzaki, Fujisawa (JP); Manabu Kodate, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 335 days.

(21) Appl. No.: 10/317,503

(22) Filed: Dec. 12, 2002

(65) Prior Publication Data

US 2004/0113900 A1 Jun. 17, 2004

(51) Int. Cl.[7] ..... G09G 3/36
(52) U.S. Cl. ..... 345/99; 345/100
(58) Field of Search ..... 345/76, 87–100, 345/204–214

(56) References Cited

U.S. PATENT DOCUMENTS 5,990,629 A * 11/1999 Yamada et al. ..... 315/169.3
6,127,998 A * 10/2000 Ichikawa et al. ..... 345/100
6,548,960 B2 * 4/2003 Inukai ..... 315/169.3

FOREIGN PATENT DOCUMENTS

JP 2000-338921 * 12/2000

* cited by examiner

*Primary Examiner*—Amr A. Awad
(74) *Attorney, Agent, or Firm*—William H. Steinberg; Ronald A. D'Alessandro

(57) ABSTRACT

An image display device where electrical potential is provided by time divisons from one display signal line to two or more pixels situated adjacent to one another in an LCD matrix. During one horizontal scanning period an electric potential from the display signal line is written to the first and second pixel electrode during a time period TA. During a time period TB an electric potential, which may be different from the electric potential provided in time period TA, is written to the second pixel electrode. Time period TA is adjusted to be longer than time period TB.

19 Claims, 27 Drawing Sheets

FIG. 11

| Name | Description |
| --- | --- |
| X STB 1st Start | 1st XSTB Start Point |
| X STB 1st End | 1st XSTB End Point |
| X STB 2nd Start | 2nd XSTB Start Point |
| X STB 2nd End | 2nd XSTB End Point |

FIG. 13

| Items | Unit | M 1 | M 2 |
|---|---|---|---|
| H Pixels | Pixels | 1024 | 1024 |
| V Pixels | Lines | 768 | 768 |
| Pixels Clock Rate | MHz | 65 | 54 |
| H Total Time<br>H Total Pixel | μs<br>Pixels | 20.677<br>1344 | 21.333<br>1152 |
| H Active Scan Time<br>H Display Pixels | μs<br>Pixels | 15.754<br>1024 | 18.963<br>1024 |
| H Blank | μs<br>Pixels | 4.923<br>320 | 2.370<br>128 |
| V Frequency (Refresh Rate) | Hz | 60 | 60 |
| V Total Line | Lines | 806 | 780 |
| V Display Lines | Lines | 768 | 768 |
| V Blank | Lines | 38 | 12 |

TARGET
ELECTRIC POTENTIAL
(Va1, Vb1, Vc1)
Shortage
Voltage
Time
TA
TB
TC
Charge A21
Charge B21
Charge C21
Gate n+1
Gate n+2
Gate n+3
STB

IMAGE DISPLAY DEVICE AND METHOD OF SUPPLYING WRITING ELECTRIC POTENTIAL TO AN IMAGE DISPLAY DEVICE

BACKGROUND OF THE INVENTION

The present invention relates to image display devices, more specifically, to a technology which contributes to achieving higher definition of a liquid crystal display device.

One of the liquid crystal display devices known to date is an active-matrix liquid crystal display device, which uses thin-film transistors (TFTs) as switching elements. The active-matrix liquid crystal display device effectuates display using an electro-optical effect of liquid crystal, by means of filling a liquid crystal material in a space between a TFT array substrate, which includes scan signal lines and display signal lines arranged in the form of matrix and thin-film transistors arranged at intersecting points thereof, and a color filter substrate disposed opposite to the substrate with provision of a given interval therebetween, and also by controlling voltages to be applied to the liquid crystal material by use of the thin-film transistors.

When the number of pixels are increased to achieve higher definition in an active-matrix liquid crystal display device, problems have been reported. Specifically, quantities of display signal lines and scan signal lines are considerably increased along with an increase in the number of pixels. Accordingly, the number of driver ICs also show a massive increase and a cost rise is thereby incurred. Moreover, electrode pitches for connection between the driver ICs and the TFT array substrate are narrowed, whereby connection becomes more difficult and yield in a connecting operation is degraded.

In order to solve these problems simultaneously, numerous proposals have been made to date for reducing the required number of driver ICs and for increasing the pitches of connection terminals by means of providing electric potential by time division from one display signal line to two or more pixels which are adjacent in a column direction. Those proposals include Japanese Unexamined Patent Publications No. 6(1994)-138851, No. 6(1994)-148680, No. 11(1999)-2837, No. 5(1993)-265045, No. 5(1993)-188395 and No. 5(1993)-303114.

SUMMARY OF THE INVENTION

As mentioned above, various circuit structures for dealing with higher definition of an active-matrix liquid crystal display device have been proposed. It is an object of the present invention to provide a method of supplying writing electric potential suitable for image display elements having such circuit structures. Another object of the present invention is to provide a device for supplying a display signal and an image display device, which are designed to perform the method of supplying writing electric potential.

The following problem may occur in an image display device where electric potential is provided by time division from one display signal line to two or more pixels adjacent in the column direction (such a structure will be hereinafter referred to as a "multipixel structure"). Specifically, in the case of the multipixel structure, a time period for writing the electric potential to each pixel is shortened. For example, if one given horizontal scanning period is divided into halves in the case of providing the electric potential from one display signal line to two pixels, then it is conceivable that writing of electric potential to one of the pixels does not reach targeted writing electric potential because of shortage of the writing time period due to writing logic, writing characteristics or the like. Therefore, in the present invention, the writing time periods for a plurality of pixel electrodes are not equalized. Instead, the lengths of the writing time periods therein are varied depending on respective pixels.

An image display device of the present invention includes a display signal line for transmitting display signals, first and second pixel electrodes coupled to first and second switching elements for receiving display signals, a scan signal line for transmitting scan signals to the first and second switching elements, and signal processing means for generating first and second display signals based on a first signal corresponding to the first pixel electrode and a second signal corresponding to the second pixel electrode which are inputted from outside, the signal processing means also generating the scan signals for causing the display signals to be provided to the first and second switching elements in a time division manner within one given horizontal scanning period HT. Moreover, in the image display device, the signal processing means sets up a time period TA for writing the first display signal and a time period TB for writing the second display signal so as to satisfy an inequality represented as TA>TB.

Since the image display device of the present invention can set up the time periods to satisfy the inequality represented as TA>TB, it is possible to solve the shortage of the writing time period with respect to the first pixel electrode.

As will be made clear from the embodiments to be described later, in the image display device having the multipixel structure, the first display signal is also written to the second pixel electrode during the time period TA when the first display signal is written to the first display signal.

Such writing of the first display signal to the second pixel electrode is equivalent to performing preliminary writing of electric potential (a pre-charge) in the second pixel electrode. Therefore, a shortage of writing time rarely occurs, even if the time period TB for writing the second display signal to the second pixel electrode is shortened.

An image display device in recent years is also required to deal with a plurality of display modes for the purpose of power saving and the like. Power consumption is from time to time curtailed by means of reducing the drive frequency. Such a power-saving mode is associated with a change of the horizontal scanning period. In order to maintain normal drive of a liquid crystal display device, the writing time periods for the respective pixel electrodes should be changed in accordance with the change of the horizontal scanning period. Accordingly, in the image display device of the present invention, it is desirable that the signal processing means resets TA and/or TB based on the assumption TA>TB when the horizontal scanning period is changed. As described in more detail hereinafter, it is not always necessary to change both TA and TB, but it is possible to change only TA or only TB.

In the image display device of the present invention, TA and TB are set within one horizontal scanning period HT. Here, TA and TB may consume one horizontal scanning period entirely or partially. That is, the signal processing means of the present invention can set HT, TA, and TB so as to satisfy an equality represented as HT=TA+TB or an inequality represented as HT>TA+TB.

Moreover, in the image display device of the present invention, the horizontal scanning period HT can be predetermined as HT=HD+HB (note that the HD refers to a time period when the first signal and/or the second signal is inputted, and HB refers to a time period when the first signal and/or the second signal are not inputted). In this case, it is desirable that the signal processing means sets TB to HD/2 or below. Alternatively, it is desirable that TA−TB is set to HB or below.

Here, as it is publicly known, a liquid crystal display device adopts an inverted drive system to prevent deterioration of a liquid crystal material therein. The inverted drive system is adopted when the image display device of the present invention is applied to the liquid crystal display device. However, in the multipixel structure, pixel electrodes connected to a common display signal line are usually supposed to be driven in the same polarity during one horizontal scanning period. Therefore, the first and second pixel electrodes in the present invention will be driven in the same polarity during one horizontal scanning period.

It is desirable that the image display device of the present invention has a structure which includes a first switching element being provided between the common display signal line and the first pixel electrode and having a gate electrode for controlling writing of a display signal, a second switching element provided between the gate electrode of the first switching element and a given scan signal line, and a third switching element connected to the given scan signal line for controlling supply of the display signal to the second pixel electrode.

As described previously, in the multipixel structure, two pixel electrodes are connected to the common display signal line, and the electric potential which is written to one of the two pixel electrodes is also written to the other pixel electrode in the same initial time period. In other words, in the two pixel multipixel structure, the pixel electrode in which the relevant electric potential is written first is not pre-charged while the second pixel electriode is pre-charged. That is, the time period for writing the electric potential in the pixel electrode to be written first should be set longer than the time period for writing the electric potential in the pixel electrode to be written subsequently. Therefore, the present invention provides an image display device which includes an image display element provided with a plurality of pixel electrodes arranged in the form of a matrix, display signal lines for transmitting electric potential to the respective pixel electrodes, and scan signal lines for transmitting scan signals. The image display device also includes signal processing means for generating and supplying the electric potential to the display signal lines. In the image display element, n of the pixel electrodes (n is an integer greater than 1) which are present on the same row are connected to the common display signal line, and the signal processing means during a given horizontal scanning period sets, a longer time period for writing the electric potential to the pixel electrode to be written first than the time periods for writing the electric potential to the other pixel electrodes to be written subsequently. It is important to set the time period for writing the electric potential in the pixel electrode to be written first and the time period for writing the electric potential in the other pixel electrodes to be written subsequently so that the desired electric potential levels are reached by the respective pixel electrodes.

In the image display device of the present invention, the image display element can adopt a multipixel structure, in which two pixel electrodes are connected to a common display signal line and the electric potential is written to a remaining pixel electrode during the time period when the electric potential is written to a targeted one of the two pixel electrodes. Moreover, in this case, it is desirable that the signal processing means sets the time period for writing the electric potential to the targeted pixel electrode to be longer than the time period for writing the electric potential to just the other pixel electrode. It is because the other pixel electrode is pre-charged when the electric potential is being written to the targeted pixel that the subsequent time period for writing the electric potential to the other pixel electrode may be curtailed accordingly.

Moreover, in the image display device of the present invention, the image display element can also adopt a multipixel structure, in which three pixel electrodes are connected to a common display signal line and the electric potential is written to remaining pixel electrodes during the time period when the electric potential is written to targeted one of the three pixel electrodes. And similarly, the signal processing means can set the time period for writing the electric potential to the targeted pixel electrode to be longer than the subsequent time periods for writing the electric potential to the other pixel electrodes.

It is desirable that the image display element in the image display device of the present invention have a configuration including first and second pixel electrodes to be arranged between an nth scan signal line (n is a positive integer) and an nth+1 scan signal line and be provided with a display signal from a given signal line, a first switching mechanism allowing passage of a scan signal when both the nth+1 scan signal line and an nth+mth (m is an integer except 0 and 1) scan signal line are selected, and a second switching mechanism allowing passage of the scan signal through the second pixel electrode when the nth+1 scan signal line is selected.

As previously described, it is necessary in the present invention to change the writing time periods when the display mode is changed. Moreover, the change of the writing time periods associated with a change of the display mode is established independently as a display signal supplying device. The display signal supplying device refers to a display signal supplying device for supplying writing electric potential to an active-matrix image display element, and the display signal supplying device includes signal supplying means for supplying writing electric potential relevant to a plurality of pixels to a given display signal line in one horizontal scanning period by time division, and writing time changing means for changing a time period for supplying the writing electric potential to at least one of the plurality of pixels.

Moreover, the writing time changing means will change the time period for supplying the writing electric potential based on a change of one horizontal scanning period. Meanwhile, the change of the time period for supplying the writing electric potential can be premised on setting the time period for supplying the writing electric potential to a given pixel out of the plurality of pixels to be longer than the time period for supplying the writing electric potential to other pixels. Furthermore, in this event, the signal supplying means gives priority to the supply of the writing electric potential to the given pixel over the supply of the writing electric potential to the other pixels.

The present invention also provides the following method of supplying writing electric potential applicable to the image display device and the display signal supplying device described above. Specifically, the method of supplying writing electric potential of the present invention refers to a method of supplying writing electric potential to an active-matrix image display element, which includes the steps of generating writing electric potential relevant to a plurality of pixels in one horizontal scanning period based on video data supplied externally, and setting a time period for supplying the writing electric potential to a given pixel out of the plurality of pixels to be longer than a time period for supplying the writing electric potential to another pixel. Here, the writing electric potential is supplied to the plurality of pixels from a common display signal line by time division.

Moreover, the method of supplying writing electric potential of the present invention refers to a method of supplying writing electric potential to an active-matrix image display element, which includes the steps of receiving external video data relevant to a plurality of pixels, generating writing electric potential relevant to the plurality of pixels based on the video data, and supplying the writing electric potential in the plurality of pixels in one horizontal scanning period by time division. Here, a time period for supplying the writing electric potential to each of the plurality of pixels is dynamically set up based on one horizontal scanning period. As a more concrete aspect, a mode of operation is to change the time period for supplying the writing electric potential to each of the plurality of pixels separately in accordance with a change of one horizontal scanning period.

BRIEF DESCRIPTION OF THE DRAWINGS

For a more complete understanding of the present invention and the advantages thereof, reference is now made to the following description taken in conjunction with the accompanying drawings.

FIG. 11 is a chart showing parameters set in a parameter register in the first embodiment.

FIG. 13 is a chart showing settings of display modes in a second embodiment.

DETAILED DESCRIPTION OF THE PREFERRED EMBODIMENTS

First Embodiment

An image display device of the present invention will be described based on an embodiment having a liquid crystal display device.

Figure 1:
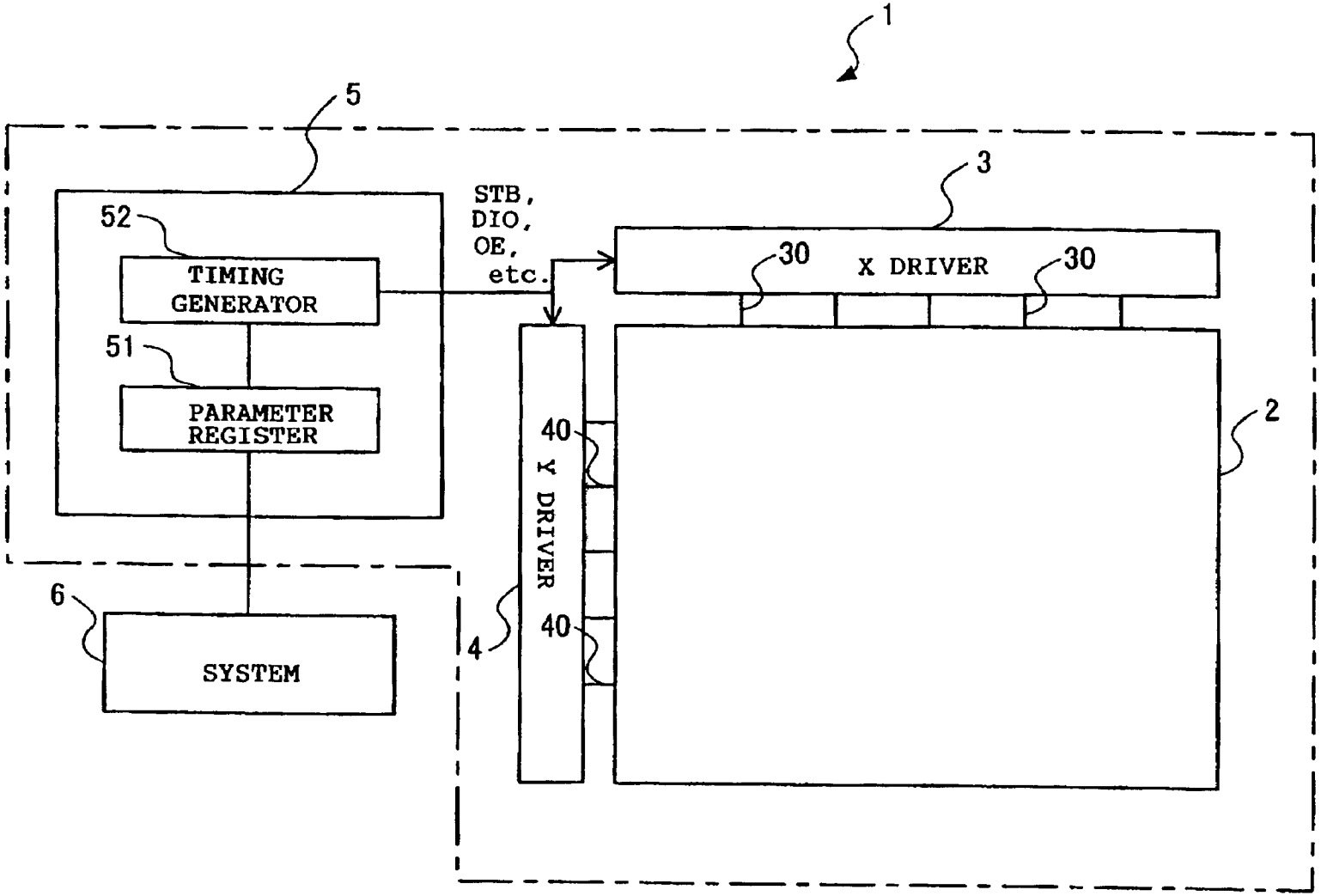
FIG. 1 is a block diagram showing a configuration of a liquid crystal display device according to a first embodiment.
Figure 2:
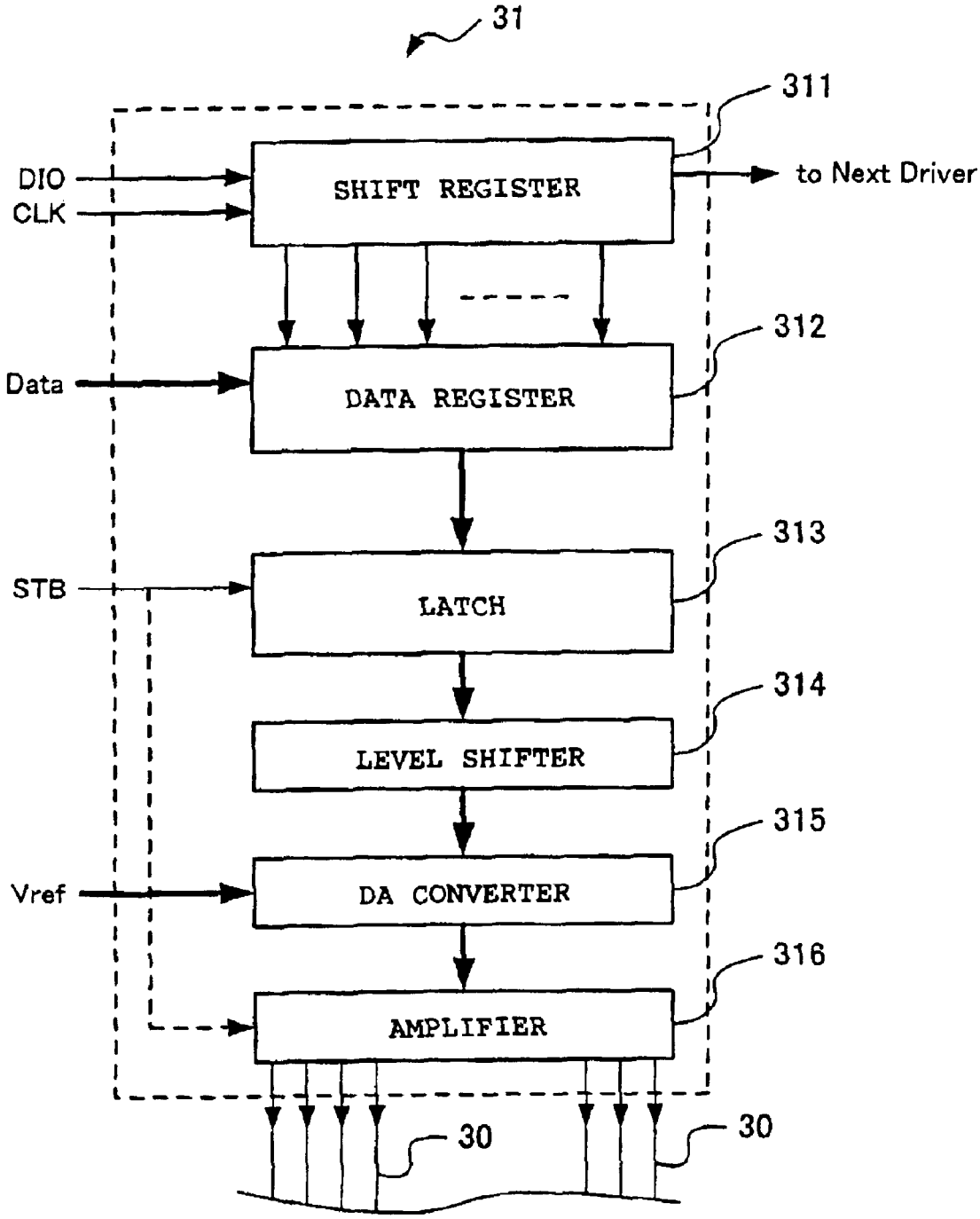
FIG. 2 is a block diagram showing a configuration of an x driver in the first embodiment.

FIG. 1 is a block diagram showing a principal configuration of a liquid crystal display device 1 according to this embodiment, and FIG. 2 is a block diagram showing a configuration of an x driver 3.

The liquid crystal display device 1 according to the embodiment is characterized in that two pixels, which are disposed adjacent to each other while sandwiching one common display signal line, are sharing the display signal line so as to reduce the total number of the display signal lines by half. In addition, the liquid crystal display device 1 of this embodiment is also characterized by having unequal time periods for supplying (writing) a display signal to the two pixels sharing one display signal line. Of course, the liquid crystal display device 1 must include other elements such as a TFT array substrate, which constitutes a display element 2, a color filter substrate which faces the TFT array substrate, and a backlight unit. However, since these elements do not constitute the characteristic part of the present invention, description thereof will be omitted.

As shown in FIG. 1, the liquid crystal display device 1 includes an x driver 3, which is a driver circuit for supplying the display signal, i.e. writing the electric potential, to the pixel electrodes arranged within the display element 2 via display signal lines 30, and a y driver 4, which is a driver circuit for supplying scan signals to control turning on and off thin-film transistors (TFTs) via scan signal lines 40. In display element 2, M×N pixels (M and N are arbitrary positive integers) are arrayed in the form of matrix.

The x driver 3 and the y driver 4 are connected to a timing controller 5. The timing controller 5 controls x driver 3 and y driver 4 by receiving digital video data (hereinafter referred to as the video data) which comprises the display signal, a synchronizing signal (Sync) and a clock signal (CLK) from a system 6, which could comprise a personal computer, for example. Signal processing means of the present invention composed independently or in combination of x driver 3, y driver 4, and timing controller 5.

The timing controller 5 includes a parameter register 51 and a timing generator 52. Parameters for deciding a strobe (STB) point are stored in parameter register 51. The strobe point refers to the time for starting to output the written data retrieved by the x driver 3 to the display signal lines 30 while converting the data into analog voltages. The timing generator 52 generates signals necessary for driving x driver 3 and y driver 4 based on the parameters stored in the parameter register 51, and outputs the signals to x driver 3 and y driver 4. In addition to STB, signals to be generated and outputted include DIO which is a shift start signal for the x driver 3, OE for the y driver 4, and the like. More detailed contents of the timing controller 5 will be described later. Moreover, the timing controller 5 may also include a block for dealing with the video data transferred from system 6 or a block for generating other control signals.

FIG. 2 is a block diagram showing a configuration of a driver element 31 which constitutes the x driver 3. As is well known, it is possible to constitute the x driver 3 with a plurality of driver elements 31.

As shown in FIG. 2, the driver element 31 includes a shift register 311, a data register 312, a latch 313, a level shifter 314, a DA (digital to analog) converter 315, and an amplifier 316. However, the configuration is not always limited to the foregoing.

The shift register 311 creates control pulses for loading the video data into the data register 312 in order. The control pulses are based on the shift start pulse DIO and on Clock Signal CLK.

The video data transferred from the timing controller 5 are stored temporarily in the data register 312. The video data stored in the data register 312 are transferred to the latch 313 in accordance with the STB signals transmitted from the timing controller 5. Voltages of the video data transferred to the latch 313 are converted into DA converter input voltages by the level shifter 314 and then the video data are supplied to the DA converter 315. The video data converted from digital signals into analog signals by the DA converter 315 are amplified to given values by the amplifier 316 and then outputted to the display signal lines 30 as display signals.

Next, a circuit structure in the display element 2 will be described based on FIG. 3. Note that FIG. 3 describes only part of the display element 2. Accordingly, the circuits with the structure as shown in FIG. 3 are formed continuously on the actual display element 2.

Figure 3:
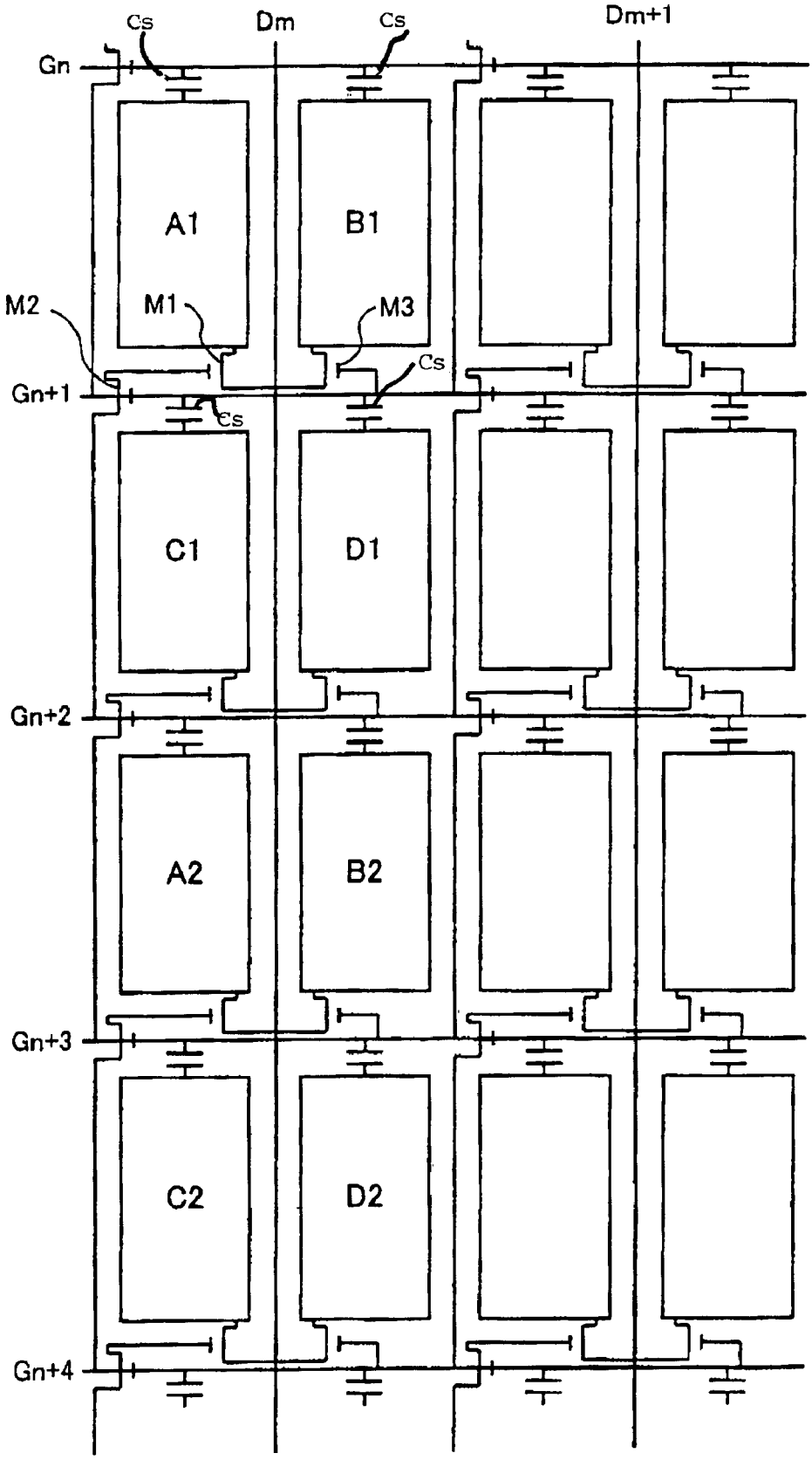
FIG. 3 is a view showing a circuit configuration of a display element in the first embodiment.

In FIG. 3, pixel electrodes A1 and B1 are situated adjacent to each other while sandwiching a display signal line Dm, a first TFT M1, a second TFT M2, and a third TFT M3 are disposed as described below.

To begin with, a source electrode of the first TFT M1 is connected to the display signal line Dm and a drain electrode thereof is connected to the pixel electrode A1. Meanwhile, a gate electrode of the first TFT M1 is connected to a source electrode of the second TFT M2. In the liquid crystal display device 1, there is a case for calling the side connected to the display signal line 30 the source electrode and the side connected to the pixel electrode the drain electrode. However, there is also a case where the above-mentioned order is reversed. That is, the rule for calling one of the two electrodes, except the gate electrode, the source electrode or the drain electrode is not uniquely determined. Therefore, the two electrodes, except the gate electrode, will be hereinafter referred to as source/drain electrodes respectively.

Next, a source/drain electrode of the second TFT M2 is connected to the gate electrode of the first TFT M1, and another source/drain electrode thereof is connected to a scan signal line Gn+2.

Accordingly, the gate electrode of the first TFT M1 is connected to the scan signal line Gn+2 via the second TFT M2. Meanwhile, a gate electrode of the second TFT M2 is connected to a scan signal line Gn+1. Therefore, the first TFT M1 is turned on only in a period when the two adjacent scan signal lines Gn+1 and Gn+2 are set to selection potential (hereinafter simply referred to as selection) simultaneously, whereby the electric potential on the display signal line Dm is supplied to the pixel electrode A1. The second TFT M2, therefore controls turning on and off of the first TFT M1.

A source/drain electrode of the third TFT M3 is connected to the display signal line Dm and another source/drain electrode thereof is connected to the pixel electrode B1. Meanwhile, a gate electrode of the third TFT M3 is connected to the scan signal line Gn+1. Accordingly, the third TFT M3 is turned on when the scan signal line Gn+1 is selected, whereby the electric potential on the display signal line Dm is supplied to the pixel electrode B1.

Next, a pixel electrode C1 located at a subsequent row to the pixel electrode A1 has a similar configuration to that of the pixel electrode A1. Moreover, a pixel electrode D1 located at a subsequent row to the pixel electrode B1 has a similar configuration to that of the pixel electrode B1.

Description has been made above regarding the circuit configuration in the display element 2 from the viewpoints of the first TFT M1 to the third TFT M3. Now, the circuit configuration in the display element 2 will be described from the viewpoints of the pixel electrode A1 and the pixel electrode B1.

The display signal is supplied to the pixel electrode A1 and the pixel electrode B1 from the single display signal line Dm shared in common. In other words, the display signal line Dm is a common display signal line Dm to the pixel electrode A1 and the pixel electrode B1. Accordingly, the display signal lines Dm consist of M/2 lines in aggregate as relevant to the matrix arrangement of the pixels of M×N. The first TFT M1 is connected to the pixel electrode A1, display signal line Dm, and to the second TFT M2. The gate electrode of the second TFT M2 is connected to the scan signal line Gn+1 and to the source/claim of TFT M1. The source/drain electrode of the second TFT M2 is connected to the scan signal line Gn+2. Here, the first TFT M1 must be turned on in order to supply the electric potential on the display signal line Dm to the pixel electrode A1. Moreover, the gate electrode of the first TFT M1 is connected to the source/drain electrode of the second TFT M2, meanwhile, the gate electrode of the second TFT M2 is connected to its own scan signal line Gn+1 and the other source/drain electrode thereof is connected to the scan signal line Gn+2 at the subsequent row. Therefore, the second TFT M2 must be turned on in order to turn on the first TFT M1. The scan signal line Gn+1 must be selected to turn on the second TFT M2, and the first TFT M1 is also turned on if the scan signal line Gn+2 is selected during the period. Accordingly, the first TFT M1 and the second TFT M2 collectively constitute a switching element which permits transmission of the scan signals when both of the scan signal line Gn+1 and the scan signal line Gn+2 are selected. The pixel electrode A1 is driven based on the scan signal from the scan signal line Gn+1 and the scan signal from the scan signal line Gn+2, so as to receive the electric potential from the display signal line Dm.

The third TFT M3 is connected to the pixel electrode B1, and the gate electrode thereof is connected to the scan signal line Gn+1. Accordingly, the electric potential is supplied from the display signal line Dm to the pixel electrode B1 when its own scan signal line Gn+1 is selected.

Description has been made above concerning the pixel electrode A1 and the pixel electrode B1. However, it is to be noted that similar configurations are applicable to a pixel electrode A2 and a pixel electrode B2, a pixel electrode C1 and a pixel electrode D1, a pixel electrode C2 and a pixel electrode D2, and other pixels.

Figure 4:
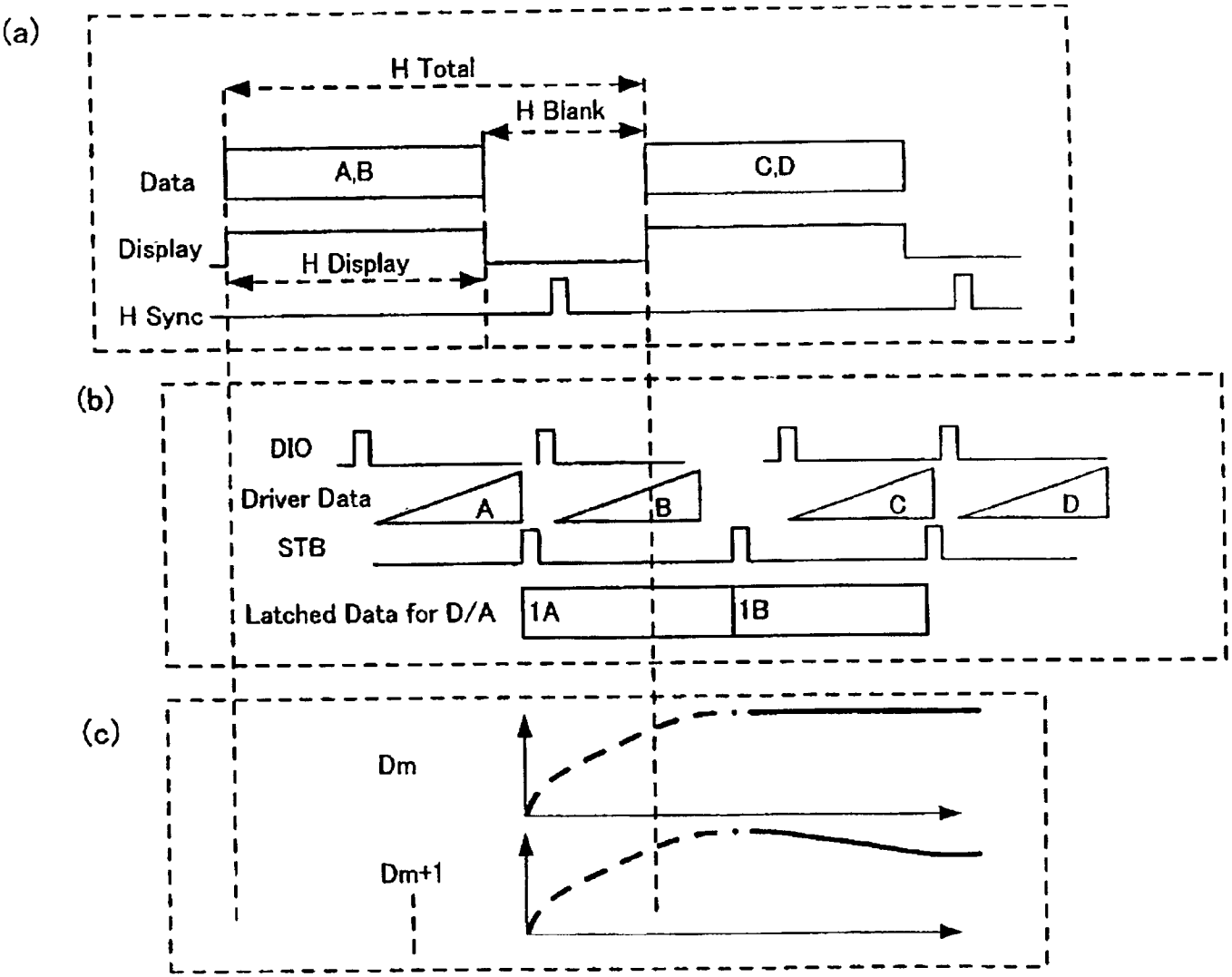
FIGS. 4A to 4C are views showing flows of video data and control signals from a system to the display element in the first embodiment.

Next, description will be made regarding the flow of video data and control signals from system 6 to display element 2 based on FIGS. 4A to 4C. FIGS. 4A to 4C are views comparatively showing the flow of video data and control signals from system 6 to display element 2. FIG. 4A shows the data and the control signals between system 6 and timing controller 5 of liquid crystal display device 1. FIG. 4B shows data and control signals between timing controller 5 and x driver 3. Furthermore, FIG. 4C shows signals outputted from x driver 3.

In FIG. 4A, one horizontal scanning period (H Total in the drawing) is composed of a time period (H Display in the drawing) for transferring the video data to be displayed in one horizontal scanning period (one horizontal-line display data), labelled data in the drawing, from system 6 to timing controller 5, and a time period (H Blank in the drawing) for not transferring the one horizontal-line display data. In other words, video data are transferred from system 6 to timing controller 5 during the time period H Display. Moreover, a horizontal synchronizing signal (H Sync in the drawing) is transferred from system 6 to timing controller 5.

In FIG. 4B, when the DIO is inputted to the shift register 311, video data are transferred from timing controller 5 to data register 312. Transfer of video data is synchronized with a clock signal to be inputted to the shift register 311. The field "Driver Data" in FIG. 4B shows a state of the video data 1A being stored in the data register 312 owing to the first DIO. The field "Driver Data" also shows a state of the video data 1B being stored into the data register 312 owing to the next DIO. Here, video data 1A refer to the video data to be written to the pixel electrodes A1, A2, and so on, and video data 1B refer to the video data to be written to the pixel electrodes B1, B2, and so on. Similarly, the video data 1C refer to the video data to be written in the pixel electrodes C1, C2, and so on, and the video data ID refer to the video data to be written to the pixel electrodes D1, D2, and so on.

When the STB is supplied to latch 313, the video data 1A stored in the data register 312 are thereby supplied to DA converter 315 via level shifter 314. The field "Latched Data for D/A" in FIG. 4B shows such a state. Video data 1A are outputted to DA converter 315 by the first STB, and video data 1B are outputted thereto by the next STB.

FIG. 4C shows the signals (voltage waveforms) to be supplied from the x driver 3 to the display signal lines 30. FIG. 4C only shows the signals with respect to two display signal lines 30 (which correspond to Dm and Dm+1 in FIG. 3). In FIG. 4C, dotted lines refer to the voltage waveforms based on the video data 1A, and solid lines refer to the voltage waveforms based on the video data 1B, respectively.

Next, a description of the operation of pixel electrode A1 and D1 relative to the selection and non-selection of the scan signal lines Gn+1 to Gn+3 with reference to circuit diagrams in FIG. 5 to FIG. 8 will be provided.

Figure 5:
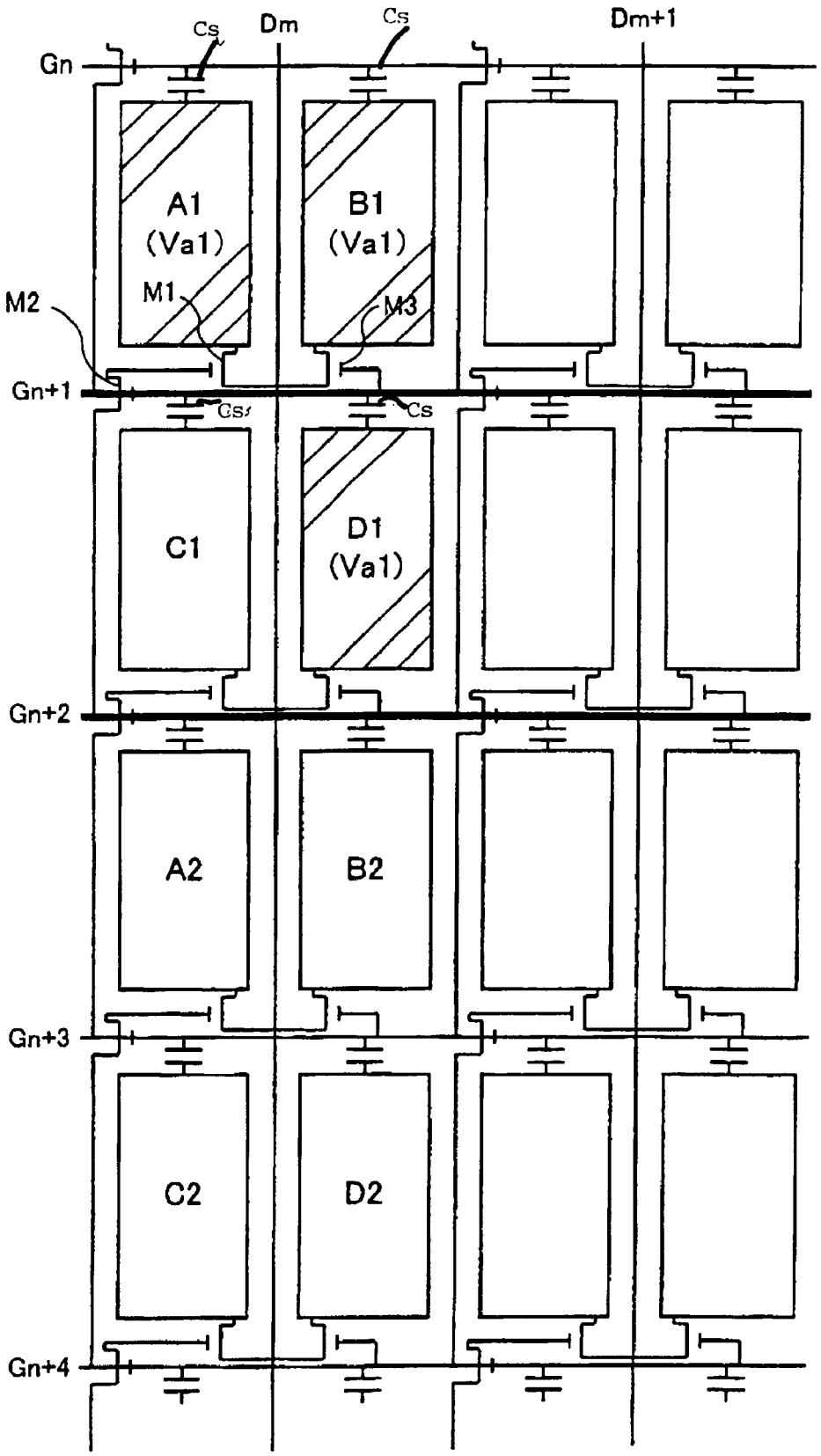
FIG. 5 is a view showing a circuit configuration of the display element in the first embodiment.

As shown in FIG. 5, the first TFT M1 to the third TFT M3 are turned on during a time period from when both scan signal line Gn+1 and the scan signal line Gn+2 are selected until when scan signal line Gn+2 is set to non-selection potential (hereinafter simply referred to as non-selection). As shown in FIG. 5, electric potential Va1 to be given by the display signal line Dm to the pixel electrode A1 is written in the pixel electrode A1, the pixel electrode B1, and the pixel electrode D1. Here, the electric potential Va1 for the pixel electrode A1 is determined. Note that bold lines in FIG. 5 show a state where scan signal line Gn+1 and scan signal line Gn+2 are selected. Moreover, the pixel electrodes where the electric potential is written are provided with hatching.

After the scan signal line Gn+2 is set to non-selection, the electric potential being supplied from the display signal line Dm is changed to electric potential Vb1 to be given to the pixel electrode B1. Electric potential Vb1 may be greater than, less than or the same as Va1.

Figure 6:
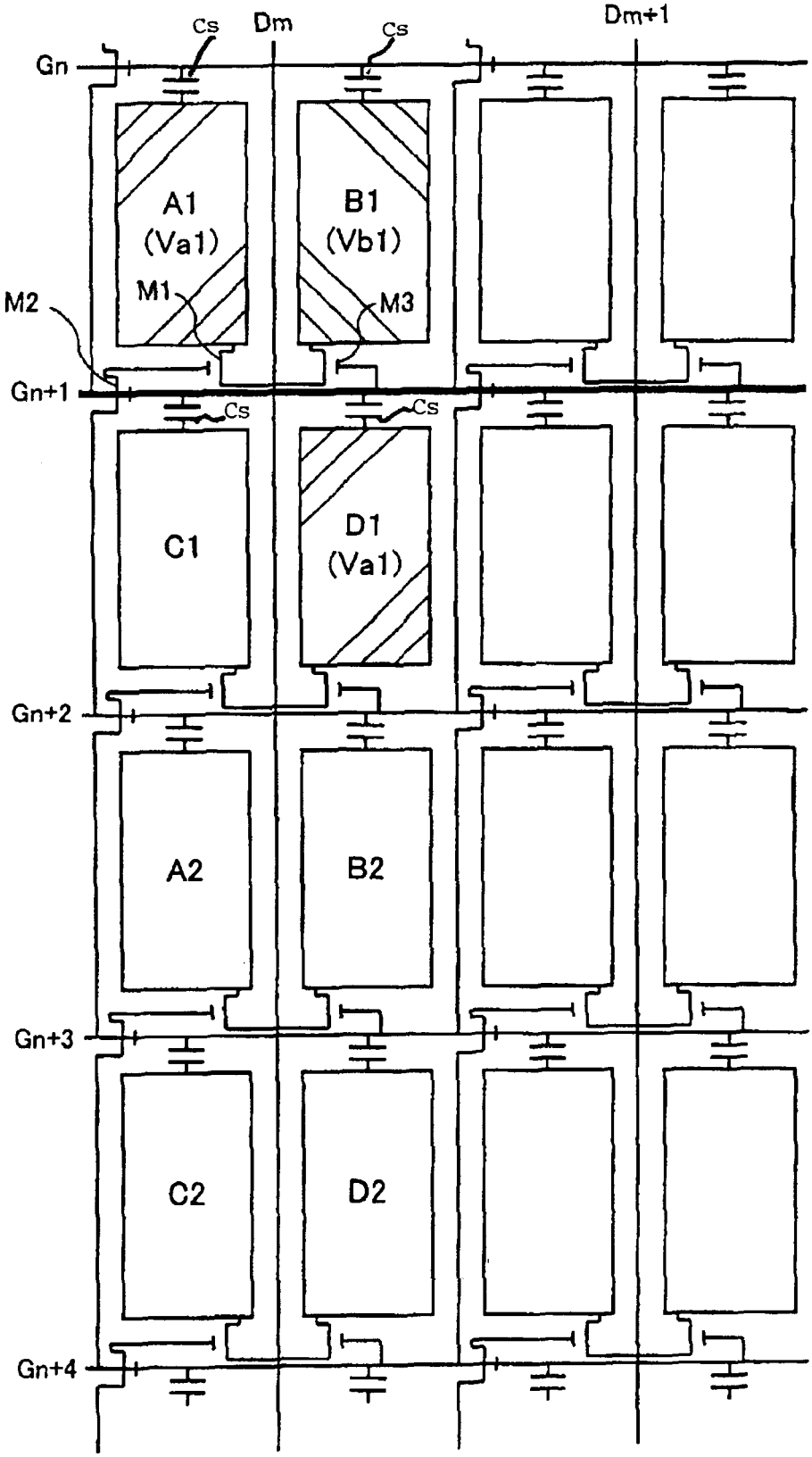
FIG. 6 is a view for explaining operation of the display element in the first embodiment.

As shown in FIG. 6, the electric potential Vb1 is written in the pixel electrode B1 by retaining the scan signal line Gn+1 selected in the time period after the scan signal line Gn+2 is set to non-selection, whereby the electric potential for the pixel electrode B1 is determined. In this way, the electric potential of the display signal line Dm is supplied to the pixel electrode A1 and the pixel electrode B1 by time division.

After the scan signal line Gn+1 is set to non-selection, the electric potential on the display signal line Dm is changed to electric potential Vc1 to be given to the pixel electrode C1. Electric potential Vc1 may be greater than, less than or equal to Vb1, depending on the target potential for the pixel connected to pixel electrode C1.

Figure 7:
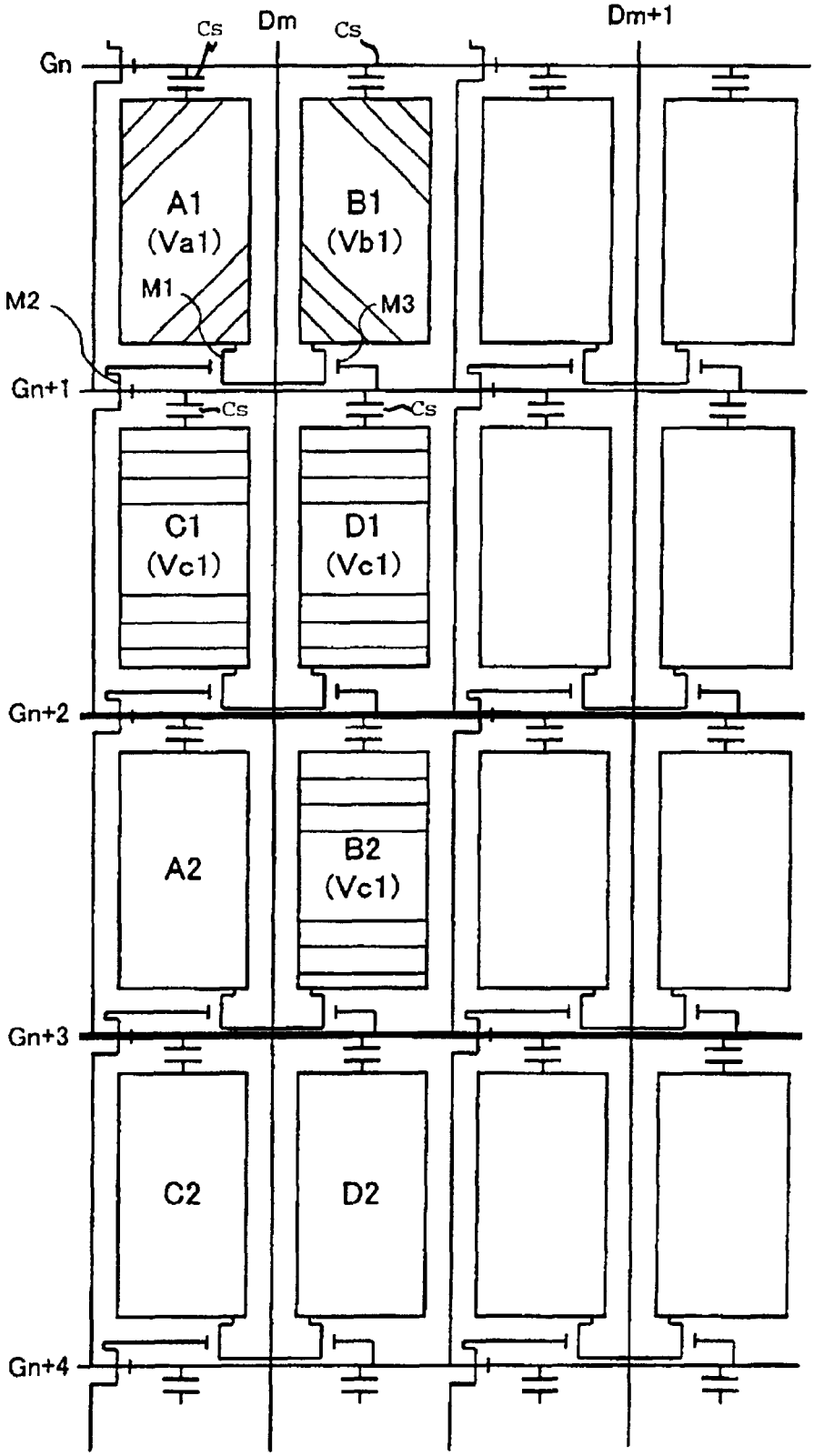
FIG. 7 is another view for explaining the operation of the display element in the first embodiment, which shows a state subsequent to the state in FIG. 6.

Meanwhile, when the scan signal line Gn+2 is selected again and the scan signal line Gn+3 is selected as well in the time period after the scan signal line Gn+1 is set to non-selection, the electric potential Vc1 is written in the pixel electrode C1, the pixel electrode D1 and the pixel electrode B2 as shown in FIG. 7. Here, the electric potential Vc1 for the pixel electrode C1 is determined.

After the scan signal line Gn+3 is set to non-selection, the electric potential being supplied from the display signal line Dm is changed to electric potential Vd1 to be given to the pixel electrode D1. Electric potential Vd1 may be greater then, less than or equal to Vc1.

Figure 8:
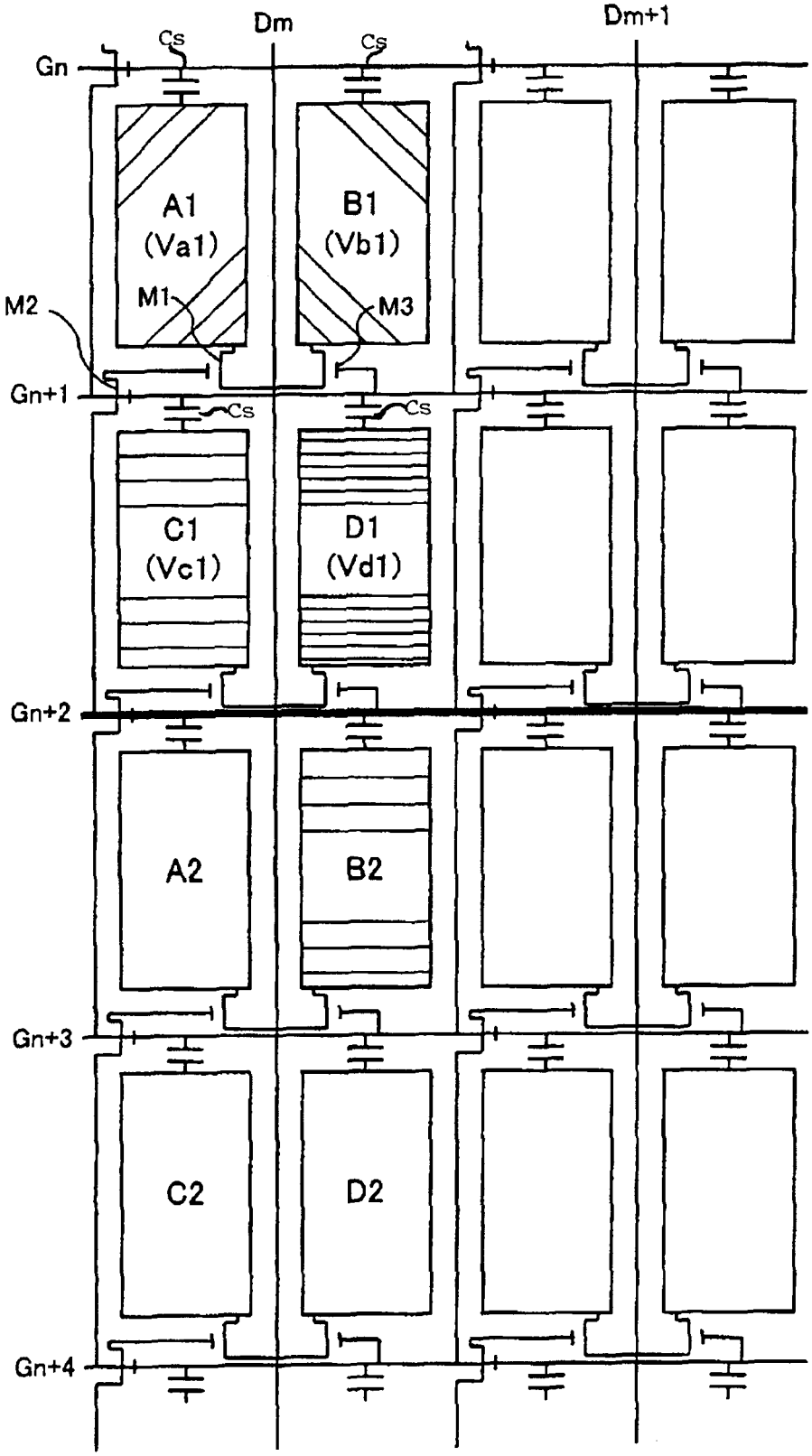
FIG. 8 is another view for explaining the operation of the display element in the first embodiment, which shows a state subsequent to the state in FIG. 7.

As shown in FIG. 8, the electric potential Vd1 is written in the pixel electrode D1 by retaining the scan signal line Gn+2 selected in the time period after the scan signal line Gn+3 is set to non-selection, whereby the electric potential for the pixel electrode D1 is determined.

Figure 9:
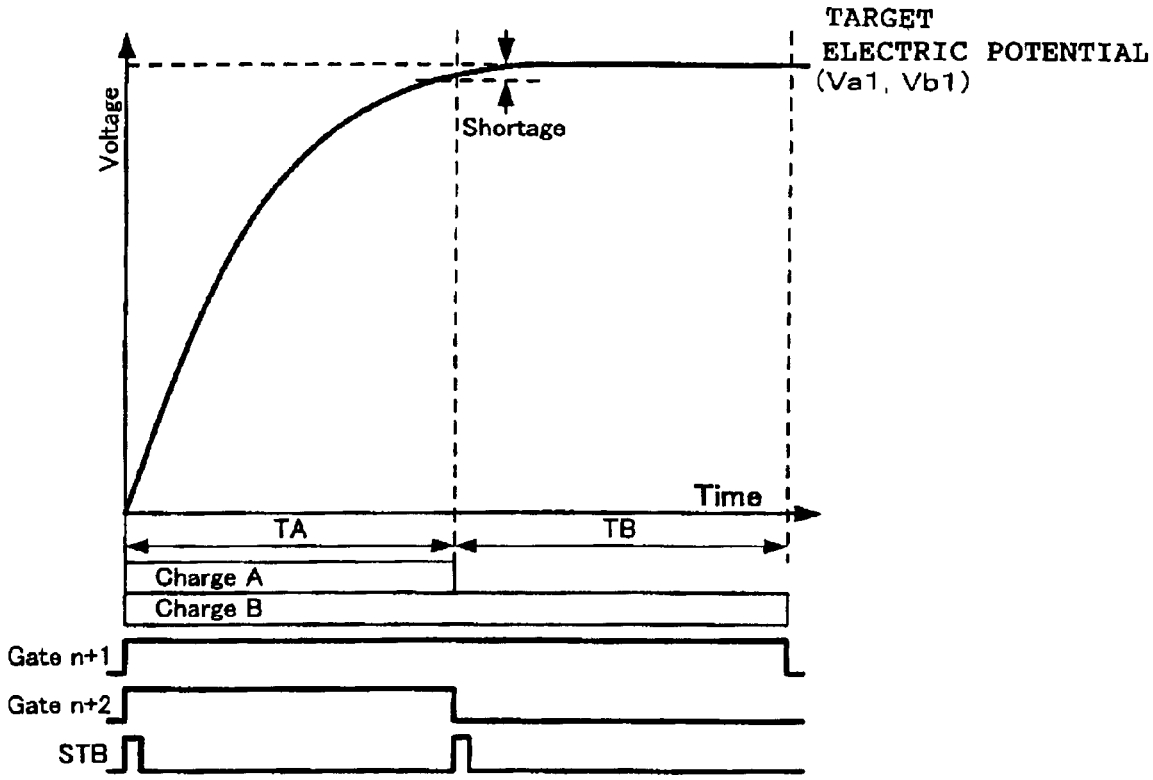
FIG. 9 is a view showing the relationship between time periods for writing electric potential and the electric potential written in a pixel electrode A1 and B1, where the time period for writing the electric potential in pixel electrodes A1 and B1 are equal.

The electric potential from the common display signal line Dm is written in the two pixel electrodes A1 and B1 by time division in one horizontal scanning period. Therefore, a time period for writing electric potential in each of the two pixel electrodes A1 and B1 becomes shorter than a conventional liquid crystal display device where one pixel electrode is connected to one display signal line Dm. Accordingly, there may be a case where the time to write the electric potential in the pixel electrode A1 is not long enough, in other words, a case where the electric potential actually written therein is lower than the electric potential that is supposed to be written (target electric potential). FIG. 9 is a view for explaining such a state.

FIG. 9 is premised on writing the same level of the electric potential in the pixel electrodes A1 and B1 (Va1=Vb1), such as in the case of desiering both pixels associated with pixel electrodes A1 and B1 to be displayed as black. In FIG. 9, a graph in an upper part shows a relation between the writing electric potential and time with respect to the pixel electrodes A1 and B1. The lines "Charge A" and "Charge B" below the graph indicate the time for writing the electric potential in the pixel electrode A1 and the time for writing the electric potential in the pixel electrode B1, respectively. Moreover, the lines "Gate n+1" and "Gate n+2" therebelow indicate selection and non-selection of the scan signal lines Gn+1 and Gn+2, respectively. Furthermore, the line STB therebelow indicates a strobe signal.

In FIG. 9, a time period TA for writing the electric potential in the pixel electrode A1 and a time period TB for writing the electric potential in the pixel electrode B1 are assumed to be equal (TA=TB). Such writing time periods are defined by the STB.

As described above, when the scan signal lines Gn+1 and Gn+2 are selected, the electric potential is written not only in the pixel electrode A1 but also in the pixel electrode B1. Next, when the scan signal line Gn+2 is not selected, the writing of the electric potential (Va1) in the pixel electrode A1 is canceled but writing of the electric potential (Vb1) in the pixel electrode B1 is continued.

In this event, since the electric potential is written in the pixel electrode B1 during the time period for writing the electric potential in the pixel electrode A1, the writing electric potential therein can easily reach the target electric potential Vb1. However, there may be a case where the writing electric potential in the pixel electrode A1 does not reach the target electric potential because the time period for writing runs short for the pixel electrode A1.

Figure 10:
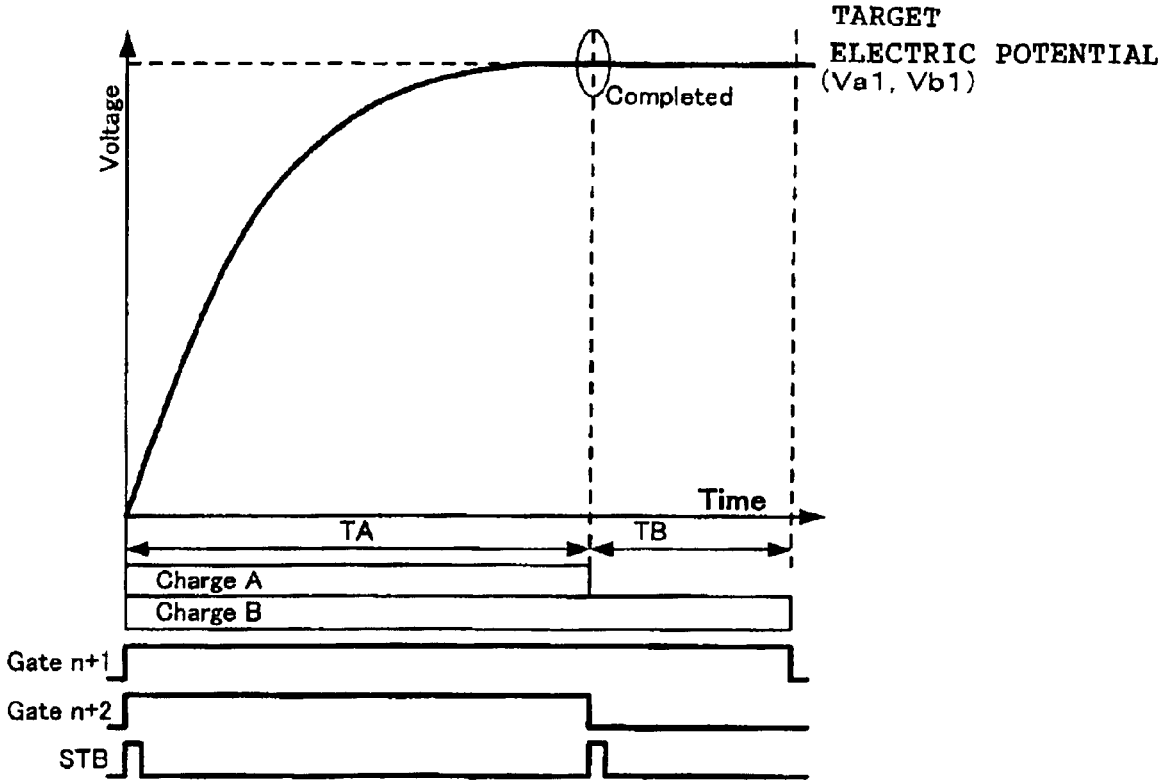
FIG. 10 is a view showing the relationship between the time periods for writing the electric potential and the electric potential written in pixel electrodes A1 and B1, in accordance with one aspect of the present invention, where the time period for writing the electric potential in pixel electrode A1 is longer than the time period for writing the electric potential in pixel electrode B1.

Therefore, in this embodiment, the time period for writing the electric potential in the pixel electrode A1 is set longer. FIG. 10 shows such an aspect. That is, in this embodiment, as shown in FIG. 10, the time period TA for writing the electric potential in the pixel electrode A1 is set longer than the time period TB for writing the electric potential in the pixel electrode B1 (TA>TB). TA is set so as not to cause the shortage of writing time in the pixel electrode A1. Although TB becomes shorter, the shortage of writing time of electric potential to pixel electrode B1 does not occur, since the electric potential is written to pixel electrode B1 during time period TA when electric potential is being written in the pixel electrode A1.

The time period TA for writing the electric potential in the pixel electrode A1 and the time period TB for writing the electric potential in the pixel electrode B1 are separately defined by the STB. Moreover, the parameters concerning start of the STB are set up in the parameter register 51 of the timing controller 5. FIG. 11 shows a concrete example thereof. In FIG. 11, a parameter X STB 1st Start and a parameter X STB 2nd Start collectively determine the starting times of the STB. Moreover, the time period TA for writing the electric potential in the pixel electrode A1 is equal to X STB 2nd Start−X STB 1st Start. Meanwhile, the time period for writing the electric potential to pixel electrode B1 is equal to H Total−TA. In this embodiment, the starting times of the STB are appropriately set up so as to satisfy an inequality represented by TA>TB.

Upon setting up the parameters, consideration should be made to effectuate sufficient saturation of writing the electric potential separately in the pixel electrode A1 and the pixel electrode B1. When the liquid crystal display device 1 adopts a normally white mode, the pixel electrode A1 requires the longest time period for writing the electric potential to display a black color. Therefore, the time period TA for writing the electric potential in the pixel electrode A1 should be determined in consideration of such a condition. Meanwhile, the pixel electrode B1 requires the longest time period for writing the electric potential when the pixel electrode B1 displays the black color in the event that the pixel electrode A1 displays a white color. Therefore, the time period TB for writing the electric potential in the pixel electrode B1 should be determined in consideration of such a condition.

Figure 12:
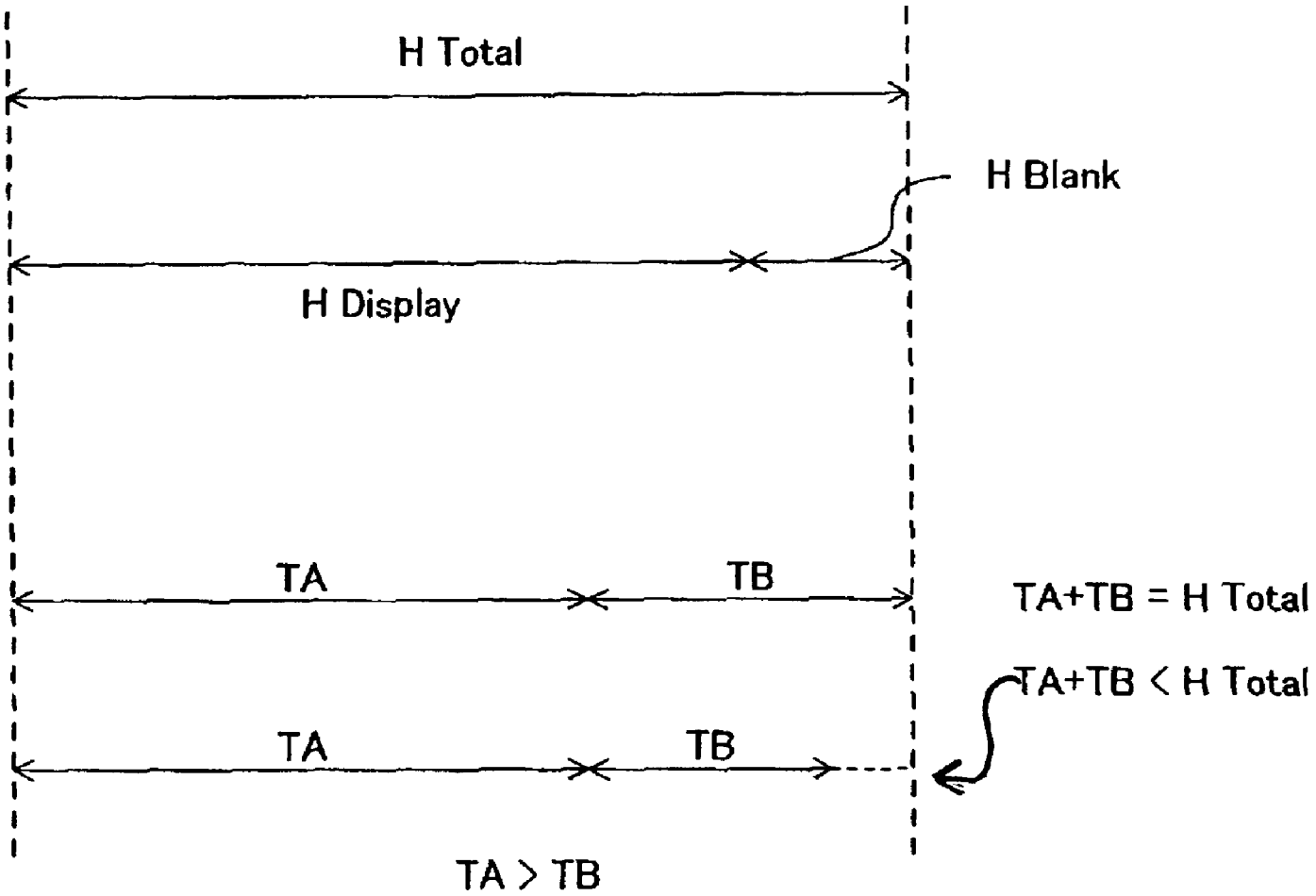
FIG. 12 is a view showing an aspect of allocating H Total to the writing time periods for the pixel electrodes A1 and B1.

Incidentally, writing electric potential in pixel electrode A1 and B1 is carried out within one horizontal scanning period (H Total). Here, H Total is the total time period of the H Display and H Blank as described above. Within the time period H Total, the inequality represented by TA>TB should be satisfied. In this event, it is also possible to use the time period H Blank for writing the electric potential in the pixel electrode A1 and the pixel electrode B1. Moreover, as shown in FIG. 12, it is possible to use the entire time period H Total in order to write the electric potential in the pixel electrode A1 and the pixel electrode B1 (TA+TB=H Total). However, without limiting the foregoing, it is also possible to use a given time period less than the entire time period H Total for writing the electric potential in the pixel electrode A1 and the pixel electrode B1, that is (TA+TB<H Total).

Here, it is desirable that the time period TB is set within ½ of the time period H Display, or TA−TB is set within the time period H Blank.

As described above, the liquid crystal display device 1 according to the first embodiment can solve the shortage of writing time with respect to the pixel electrode A1 by setting the time period TA for writing the electric potential in the pixel electrode A1 to be longer than the time period TB for writing the electric potential in the pixel electrode B1.

The liquid crystal display device 1 according to the first embodiment adopts the configuration in which the driving electric potential is written from one display signal line such as the display signal line Dm in the two adjacent pixel electrodes A1 and B1 that sandwich the display signal line Dm. Therefore, it is possible to reduce the number of the display signal lines, that is, the number of data drivers, by half as compared to the conventional liquid crystal display device in which the pixels and the display signal lines correspond one-to-one. Moreover, in the liquid crystal display device 1 according to the first embodiment, the first TFT M1 to be connected to the pixel electrode A1 and the second TFT M2 to be connected to the pixel electrode B1 are connected directly to the common display signal line Dm. Therefore, it is not necessary to design large TFTs in order to secure desired voltage levels, unlike one containing two TFTs connected in series between the display signal line and the pixel electrode. In other words, according to the first embodiment, it is possible to reduce the sizes of the first TFT M1 and the second TFT M2.

In the liquid crystal display device 1 according to the first embodiment, a storage capacitor Cs is disposed in a space between each pixel electrode and the scan signal line in the previous row. In other words, as shown in FIG. 3, the storage capacitors Cs for the pixel electrodes A1 and B1 are provided between the scan signal line Gn and the respective electrodes, and the storage capacitors Cs for the pixel electrodes C1 and D1 are provided between the scan signal line Gn+1 and the respective electrodes. The scan signal line Gn is not involved in driving pixel electrodes A1 and B1. Scan signal line Gn+1 is not involved in driving pixel electrodes C1 and D1. Here, the electric potential on scan signal line Gn does not fluctuate during the time period when the electric potential from the display signal lines Dm and Dm+1 is written to the pixel electrodes A1 and B1, and also in the time period immediately thereafter. Therefore, fluctuation of pixel electric potential on the pixel electrodes A1 and B1 can be avoided. Accordingly, it is possible to control the pixel electric potential accurately. Such an aspect constitutes a remarkable advantage in terms of image quality. Therefore, it is possible to offer high-quality images.

Second Embodiment

Now, description will be made regarding a second embodiment according to the present invention.

The first embodiment has been described on the premise that the image display modes was limited to one type (in other words, the display mode was fixed). On the contrary, a liquid crystal display device compatible with a plurality of display modes is desirable for the purpose of powersaving. The second embodiment is an example of adapting the present invention to the liquid crystal display device including a plurality of display modes. It is to be noted that the basic configuration of the liquid crystal display device according to the second embodiment is identical to the configuration of the liquid crystal display device 1 according to the first embodiment. Accordingly, description will be made below only in light of different points thereof.

FIG. 13 shows an example of two types of display modes adopted by the liquid crystal display device of XGA resolution capability. Here, a mode 1 (M1) indicates a normal display mode, and a mode 2 (M2) indicates a power-saving display mode. In mode M2, Pixels Clock Rate is reduced more than in mode M1 by means of curtailing H Blank time and thereby reducing the number of H Total Pixels but the number of displayed pixels.

Description will be made based on FIG. 14 regarding a problem in the case of changing the display mode as described above.

Figure 14:
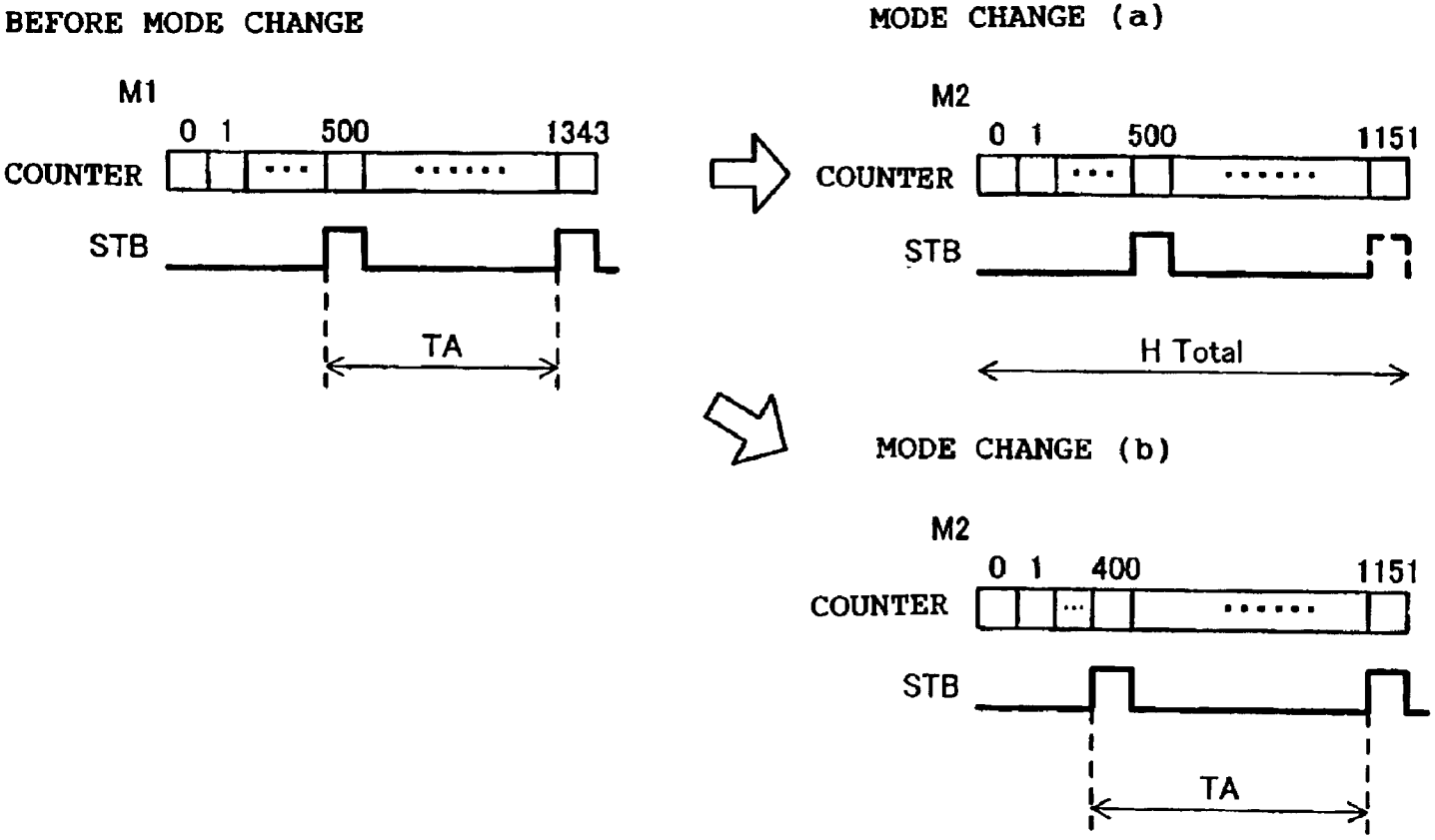
FIG. 14 is a view for explaining a problem upon a change of the display mode and explaining a method of solving the problem.

In FIG. 14, the liquid crystal display device 1 is assumed to be driven by M1 (normal display mode) in the beginning (before a mode change). In this event, the number of pixels in the horizontal direction including the horizontal blank time is 1344. A counter runs from 0 to 1343 during the horizontal scan time. There are 1024 pixels actually displayed and the counter counts an additional 320 pixel to take into account the horizontal blank time. The STB is generated at the 500th count and the 1343rd count, and the electric potential is assumed to be written in the pixel electrode A1 during the interval (TA) between the 500th and 1343rd count.

When the display mode is changed to M2, it means a change to the horizontal scanning period (H Total). Now, if the setting of the STB remains unchanged, then it is impossible to output the second STB because the counter is reduced to 1151 as illustrated in Mode Change (a) in FIG. 14. The number of pixels in the horizonal direction including the horizontal blank is reduced to 1152 with the counter running from 0 to 1151. Since the horizontal blank time is reduced in M2, see FIG. 13, the counter needs to count less pixels. Accordingly, the liquid crystal display device 1 can no longer perform normal driving.

Therefore, in the second embodiment, the timing for generating the STB can be re-set when the display mode, i.e. the H Total is changed. Such an aspect is illustrated in Mode Change (b) in FIG. 14. In this example, generation of the STB is shifted to the 400th count and to the 1151st count along with a change of the display mode to M2.

Figure 15:
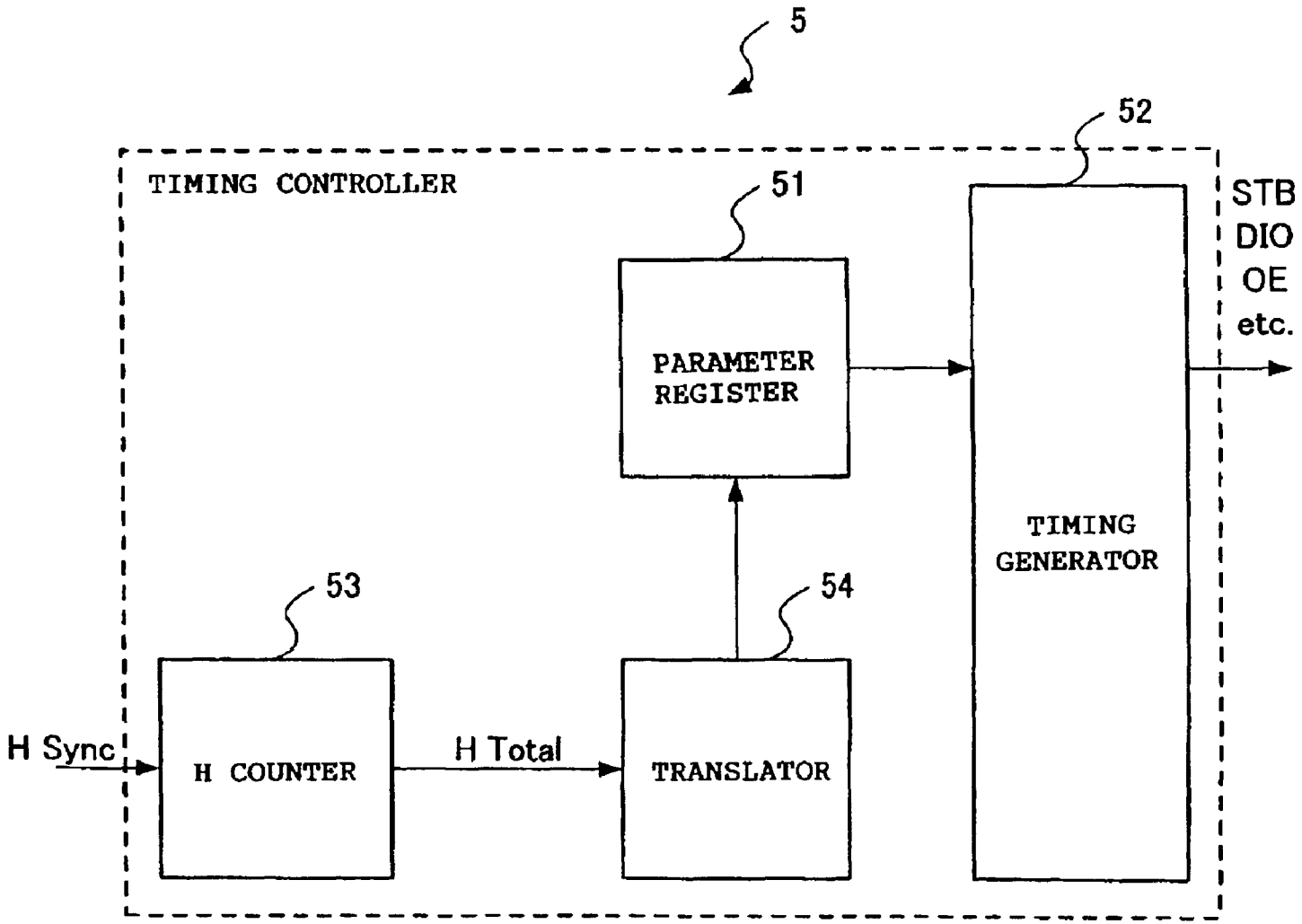
FIG. 15 is a block diagram showing a timing controller in the second embodiment.

H Total is monitored to change the timing for generating the STB as described above. To achieve the foregoing, in the second embodiment, the timing controller 5 includes an H counter 53 and a translator 54 as shown in FIG. 15. In the timing controller 5 shown in FIG. 15, H Total is measured based on the inputted horizontal synchronizing signal (H Sync), and the optimum parameters are determined by the translator 54. The setting of the parameter register 51 is changed in accordance with the determined parameters. The timing generator 52 generates the signals such as the STB, the DIO, and the OE based on the parameters. Those signals are supplied to the x driver 3 and to the y driver 4.

Various modes are conceivable upon determination of the timing for generating the STB in the translator 54. For example, the liquid crystal display device 1 can be driven by using X Data Strobe Point A when H Total is a given value or above, and it can be driven by using X Data Strobe Point B when H Total is below the given value. It is also possible to prepare n+1 X Data Strobe Points and n+1 sets of parameters while increasing thresholds up to n values. It is also possible to calculate the parameters based on the measured H Total instead of preparing all the sets of parameters. For example, one conceivable mode is to drive the liquid crystal display device 1 by using Basic X Data Strobe Point+$\alpha$ when the H Total is a certain value or above, and to drive the liquid crystal display device 1 by using Basic X Data Strobe Point+$\beta$ when the H Total is below the certain value. Alternatively, the parameters can be also calculated from a variation amount $\delta$ of the H Total. For example, one conceivable mode is to drive the liquid crystal display device 1 by using Basic X Data Strobe Point+f($\delta$), wherein f is a function of $\delta$ from a standard H Total.

As shown in FIG. 11, the parameters X STB 1st Start, X STB 1st End, X STB 2nd Start and X STB 2nd End must be considered as the parameters to be transferred from the translator 54 to the parameter register 51. Moreover, as previously described, the parameters X STB 1st Start and X STB 2nd Start determine the initial timing of the STB. Furthermore, the time period TA for writing the electric potential in the pixel electrode A1 is equal to X STB 2nd Start−X STB 1st Start. Meanwhile, the time period for writing the electric potential in the pixel electrode B1 is equal to H Total−TA. Although it is not illustrated in FIG. 11, other parameters such as parameters concerning the y driver 4 are changed appropriately along with a change of the parameters X STB 1st Start, X STB 1st End, X STB 2nd Start and X STB 2nd End. However, description will be omitted herein because such a change does not influence the present invention.

As described above, according to the second embodiment, it is possible to execute appropriate writing of the electric potential to the pixel electrodes A1 and B1 even in the case where the display mode is changed.

Third Embodiment

A third embodiment of the present invention will now be described.

While the first embodiment showed the example in which two pixel electrodes are connected to one common display signal line, the present invention is also effective when three pixel electrodes are connected to one common display signal line as will be described hereinafter. It is to be noted that the basic configuration of the liquid crystal display device according to this embodiment coincides with the configuration of the liquid crystal display device 1 according to the first embodiment, except that three pixel electrodes are connected to one common display signal line. Accordingly, description will be made below only in light of different points thereof.

Figure 16:
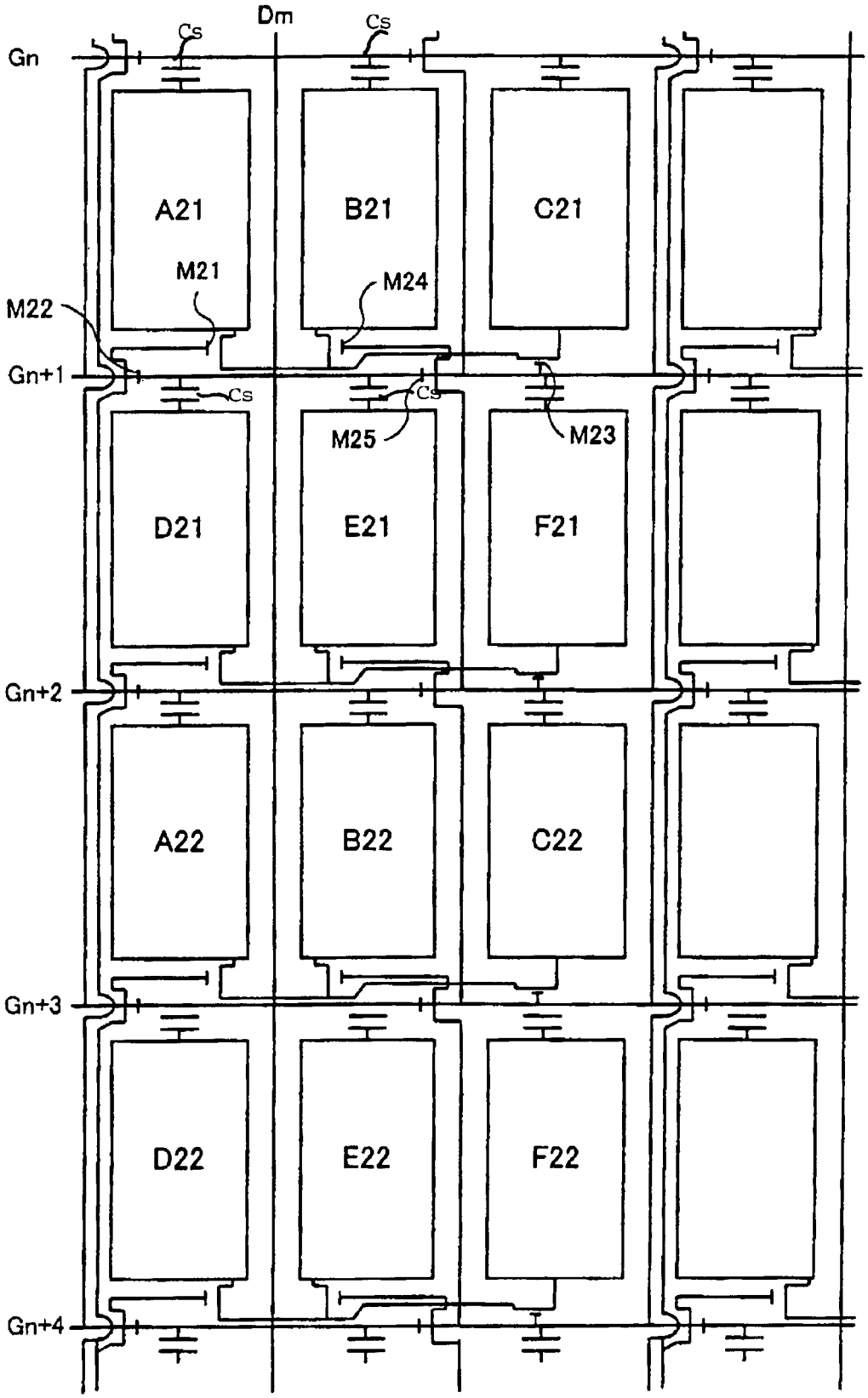
FIG. 16 is a view showing a circuit configuration of a display element according to a third embodiment.

FIG. 16 shows a circuit configuration of a display element 2 of a liquid crystal display device 1 according to the third embodiment.

Specifically, as shown in FIG. 16, in the display element 2 of the liquid crystal display device 1 of the third embodiment, a display signal line Dm is shared by three pixel electrodes of a pixel electrode A21 (a pixel electrode D21, and so on), a pixel electrode B21 (a pixel electrode E21, and so on), and a pixel electrode C21 (a pixel electrode F21, and so on). Moreover, data electric potential on the display signal line Dm is written to the pixel electrode A21 when both scan signal line Gn+1 and scan signal line Gn+3 are selected. Meanwhile, the data electric potential on the display signal line Dm is written in the pixel electrode B21 when the scan signal line Gn+1 and a scan signal line Gn+2 are selected. The data electric potential on the display signal line Dm is written in the pixel electrode C21 when the scan signal line Gn+1 is selected.

In order to effectuate the above-described operations, in the third embodiment, dispositions of switching elements from a first TFT M21 to a fifth TFT M25 are arranged as described below.

Specifically, as shown in FIG. 16, one source/drain electrode of the first TFT M21 is connected to the pixel electrode A21, and another source/drain electrode thereof is connected to the display signal line Dm. Meanwhile, a gate electrode of the first TFT M21 is connected to a source/drain electrode of the second TFT M22.

One source/drain electrode of the second TFT M22 is connected to the scan signal line Gn+3, and another source/drain electrode thereof is connected to the gate electrode of the first TFT M21. Accordingly, the gate electrode of the first TFT M21 is connected to the scan signal line Gn+3 via the second TFT M22. Meanwhile, a gate electrode of the second TFT M22 is connected to the scan signal line Gn+1. Therefore, the first TFT M21 is turned on only in a period when the two scan signal lines Gn+1 and Gn+3 are selected simultaneously, whereby the electric potential on the display signal line Dm is written to the pixel electrode A21. Therefore, second TFT M22 is a switching element for controlling turning on and off of the first TFT M21.

One source/drain electrode of the third TFT M23 is connected to the display signal line Dm, and another source/drain electrode thereof is connected to the pixel electrode C21. Meanwhile, a gate electrode of the third TFT M23 is connected to the scan signal line Gn+1.

One source/drain electrode of the fourth TFT M24 is connected to the display signal line Dm, and another source/drain electrode thereof is connected to the pixel electrode B21. Meanwhile, a gate electrode of the fourth TFT M24 is connected to a source/drain electrode of the fifth TFT M25.

One source/drain electrode of the fifth TFT M25 is connected to the scan signal line Gn+2, and another source/drain electrode thereof is connected to the gate electrode of the fourth TFT M24. Accordingly, the gate electrode of the fourth TFT M24 is connected to the scan signal line Gn+2 via the fifth TFT M25. Meanwhile, a gate electrode of the fifth TFT M25 is connected to the scan signal line Gn+1. Therefore, the fourth TFT M24 is turned on only in a period when the two scan signal lines Gn+1 and Gn+2 are selected simultaneously, whereby the electric potential on the display signal line Dm is supplied to the pixel electrode B21. Therefore, fifth TFT M25 is a switching element for controlling turning on and off the fourth TFT M24.

Description has been made above regarding the circuit configuration of an array substrate from the viewpoints of the first TFT M21 to the fifth TFT M25. Now, the circuit configuration in the display element 2 will be described from the viewpoints of the pixel electrodes A21, B21, and C21.

The display signal is written to the pixel electrodes A21, B21, and C21 from the single display signal line Dm. In other words, the display signal line Dm is a common display signal line to the pixel electrode A21 to the pixel electrode C21. The first TFT M21 and the second TFT M22 are connected to the pixel electrode A21, wherein the first TFT M21 is connected to the display signal line Dm and to the second TFT M22 as well. The gate electrode of the second TFT M22 is connected to its own scan signal line Gn+1, and the source/drain electrode of the second TFT M22 is connected to the scan signal line Gn+3 at a subsequent stage. Here, the first TFT M21 must be turned on in order to write the electric potential on the display signal line Dm to the pixel electrode A21. Moreover, the gate electrode of the first TFT M21 is connected to the source/drain electrode of the second TFT M22. Meanwhile, the gate electrode of the second TFT M22 is connected to the scan signal line Gn+1 located at the subsequent stage to the pixel electrode A21 as well as the pixel electrode B21, and the other source/drain electrode thereof is connected to the scan signal line Gn+3 subsequent to the scan signal line Gn+1. Therefore, the second TFT M22 must be turned on in order to turn on the first TFT M21. The scan signal line Gn+1 and the scan signal line Gn+3 at the subsequent stage must be selected to turn on the second TFT M22. In this way, the pixel electrode A21 is driven based on the scan signal from the scan signal line Gn+1 and the scan signal from the scan signal line Gn+3, so as to receive the electric potential from the display signal line Dm.

The fourth TFT M24 and the fifth TFT M25 are connected to the pixel electrode B21, wherein the fourth TFT M24 is connected to the display signal line Dm and to the fifth TFT M25 as well. The gate electrode of the fifth TFT M25 is connected to the scan signal line Gn+1, and the source/drain electrode of the fifth TFT M25 is connected to the scan signal line Gn+2. Here, the fourth TFT M24 must be turned on in order to write the electric potential on the display signal line Dm in the pixel electrode B21. Moreover, the gate electrode of the fourth TFT M24 is connected to the source/drain electrode of the fifth TFT M25. Meanwhile, the gate electrode of the fifth TFT M25 is connected to the scan signal line Gn+1, and the other source/drain electrode thereof is connected to the scan signal line Gn+2. Therefore, the fifth TFT M25 must be turned on in order to turn on the fourth TFT M24. The scan signal line Gn+1 and the scan signal line Gn+2 must be selected to turn on the fifth TFT M25. Eventually, the electric potential on the display signal line Dm is supplied to the pixel electrode B21 only when the scan signal line Gn+1 located subsequent thereto, and the scan signal line Gn+2 also subsequent thereto are selected.

Meanwhile, the third TFT M23 is connected to the pixel electrode C21, wherein a gate electrode thereof is connected to the scan signal line Gn+1. Accordingly, the electric potential on the display signal line Dm is supplied to the pixel electrode C21 when the scan signal line Gn+1 is selected.

Description has been made above concerning the pixel electrode A21 to the pixel electrode C21. However, it is to be noted that similar configurations are also applicable to a pixel electrode D21 to a pixel electrode F21, and other pixels thereafter.

Figure 18:
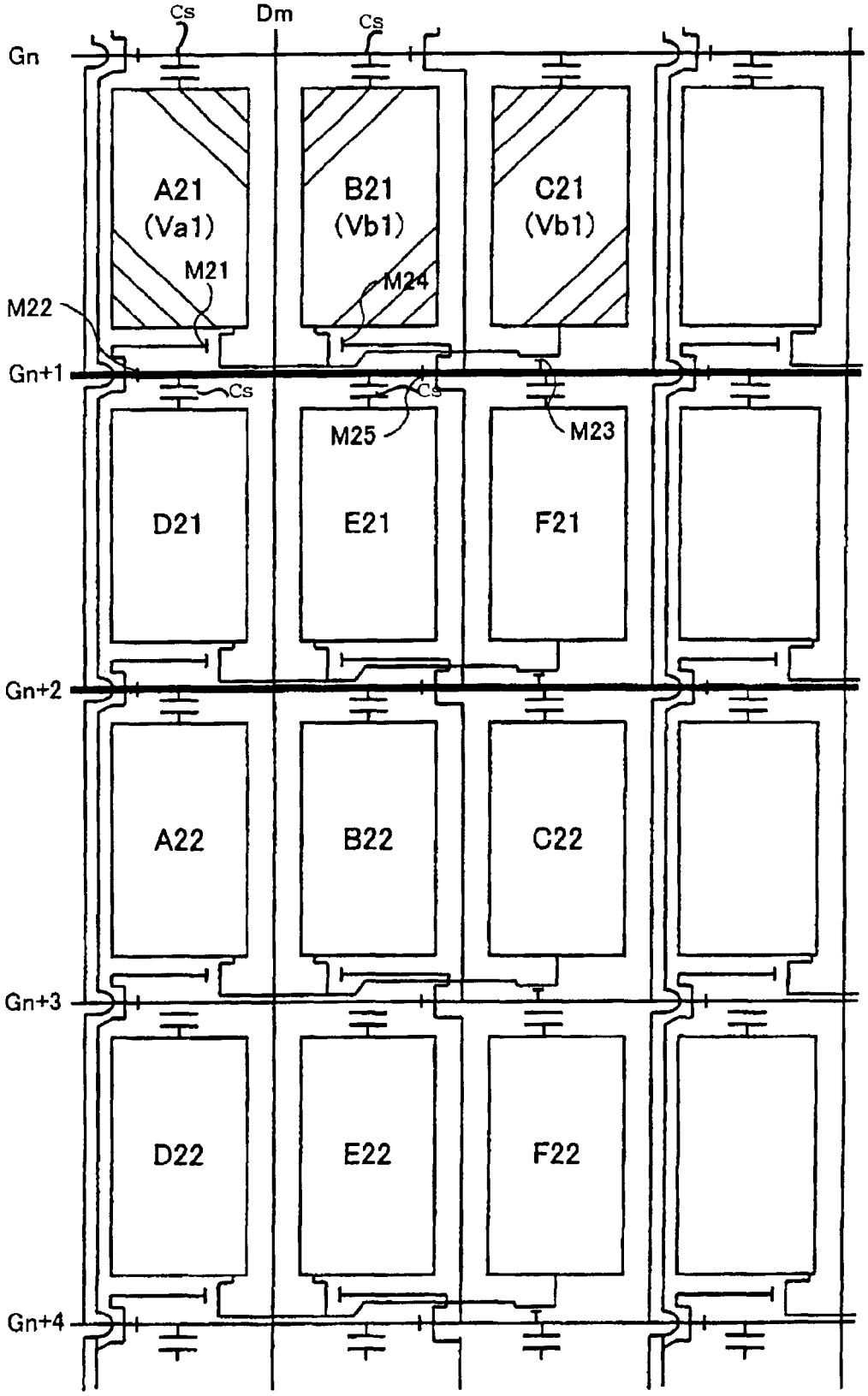
FIG. 18 is another view for explaining the operation of the display element in the third embodiment, which shows a state subsequent to the state in FIG. 17.
Figure 19:
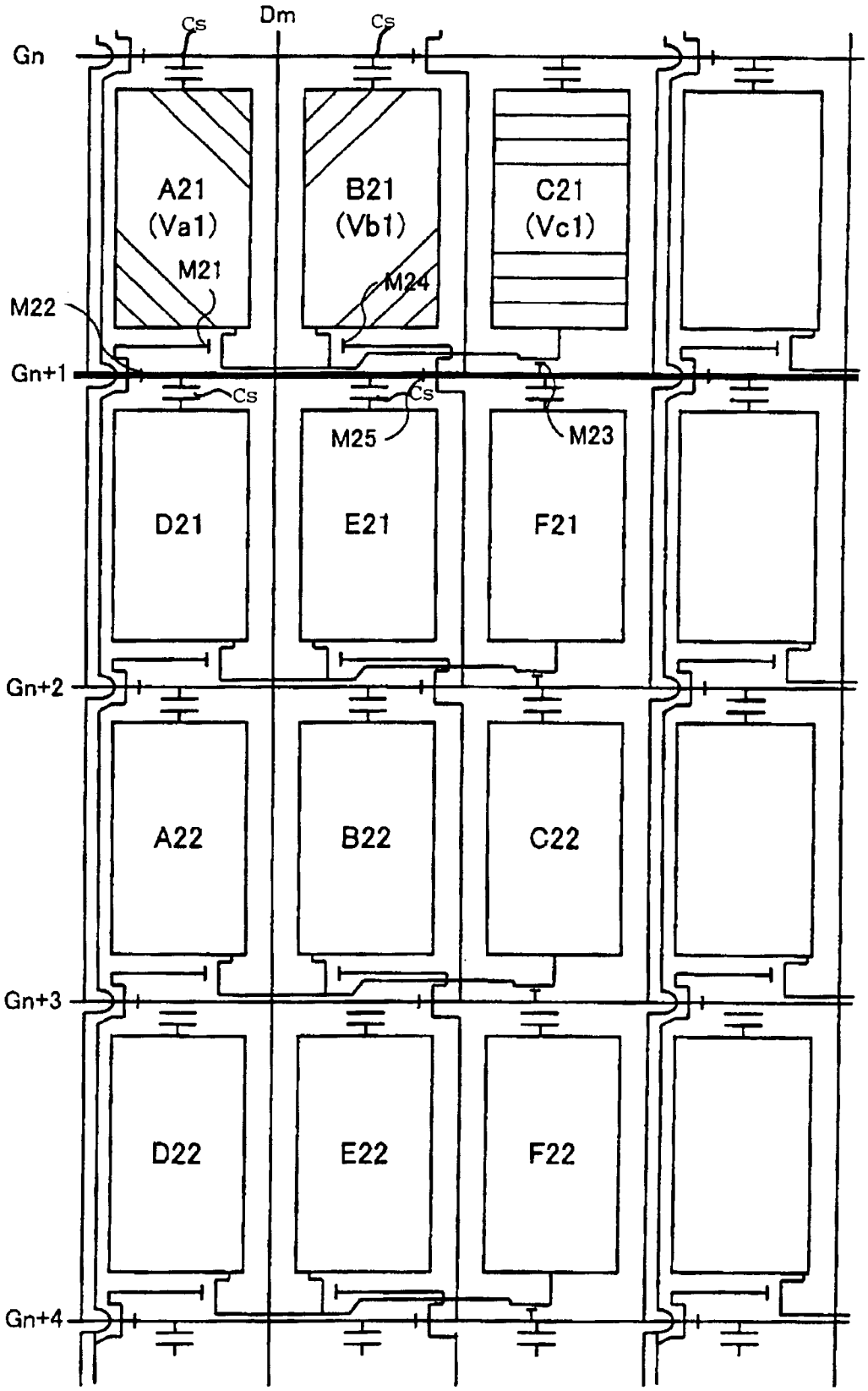
FIG. 19 is another view for explaining the operation of the display element in the third embodiment, which shows a state subsequent to FIG. 18.

In display element 2 shown in FIG. 16, the scan signal lines Gn+1, Gn+2, and Gn+3 are assumed to be selected in accordance with the following procedures within one horizontal scanning period (H Total). First, all the scan signal lines Gn+1, Gn+2, and Gn+3 are selected. Next, the scan signal lines Gn+1 and Gn+2 are selected and the scan signal line Gn+3 is not selected. Subsequently, the scan signal line Gn+1 is selected and the scan signal lines Gn+2 and Gn+3 are not selected. Operation of the display element 2 in the case of executing the above-mentioned selection procedures will be described based on FIG. 17 to FIG. 19. Note that FIG. 17 to FIG. 19 illustrate the operation of the pixel electrodes A21 to C21 only.

Figure 17:
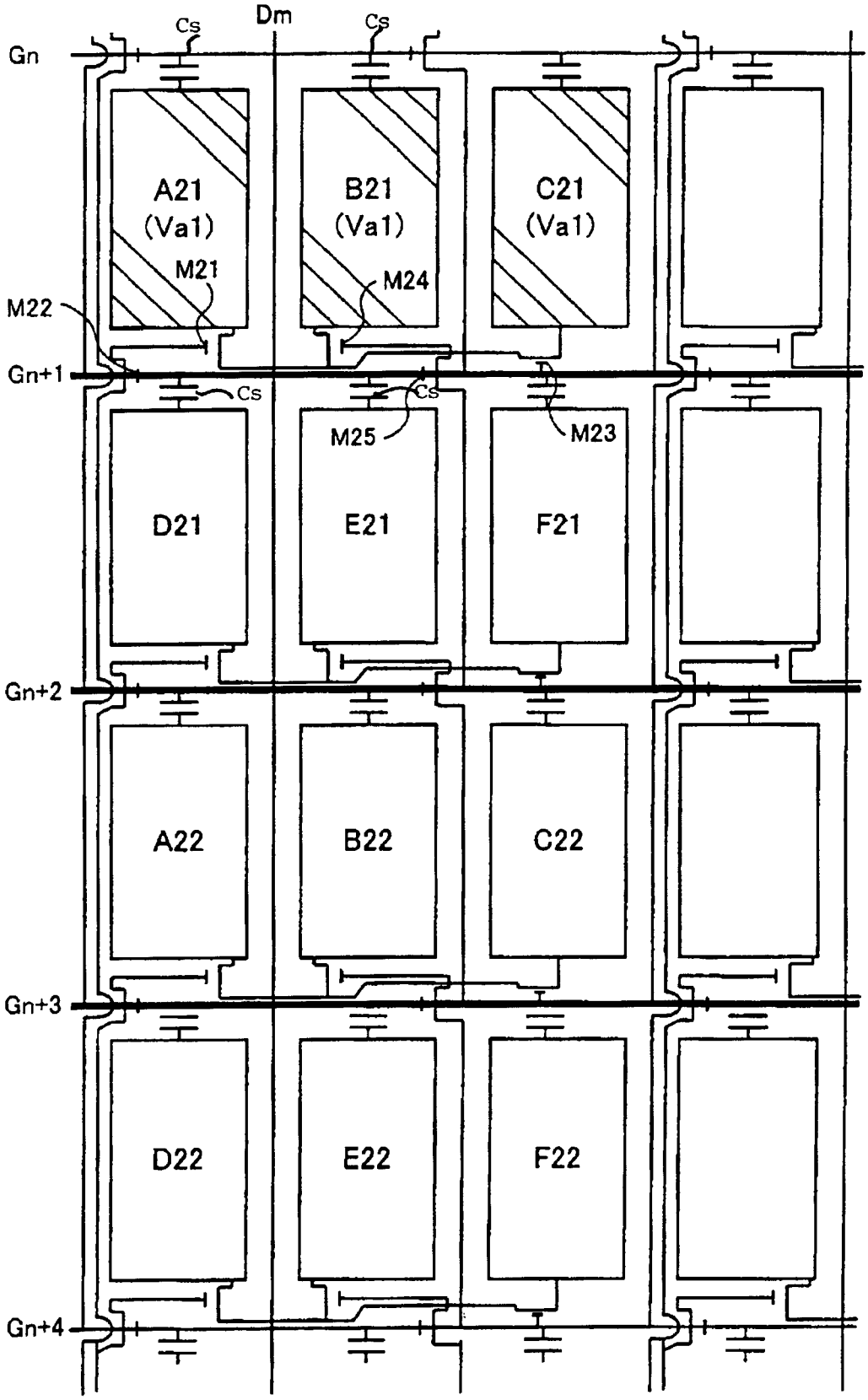
FIG. 17 is a view for explaining the operation of the display element in the third embodiment.

As shown in FIG. 17, during a time period from selection of all the scan signal lines Gn+1, Gn+2, and Gn+3 to non-selection of the scan signal line Gn+3, the first TFT M21 to the fifth TFT M25 are turned on. As shown in FIG. 17, electric potential Va1 to be supplied by the display signal line Dm to the pixel electrode A21 is written to the pixel electrode A21, the pixel electrode B21, and the pixel electrode C21. Here, the electric potential Va1 for the pixel electrode A21 is determined.

After the scan signal line Gn+3 is set to non-selection, the electric potential being supplied from the display signal line Dm is changed to electric potential Vb1 to be given to pixel electrode B21. As shown in FIG. 18, the electric potential Vb1 is supplied to the pixel electrode B21 and the pixel electrode C21 by retaining the scan signal lines Gn+1 and Gn+2 selected in the time period after the scan signal line Gn+3 is set to non-selection. Moreover, the electric potential Vb1 for the pixel electrode B21 is determined in the event that the scan signal line Gn+2 is set to non-selection in addition to the scan signal line Gn+3.

After the scan signal line Gn+2 is also set to non-selection in addition to the scan signal line Gn+3, the electric potential being supplied from the display signal line Dm is changed to electric potential Vc1 to be given to the pixel electrode C21. As shown in FIG. 19, the electric potential Vc1 is written to the pixel electrode C21.

Figure 20:
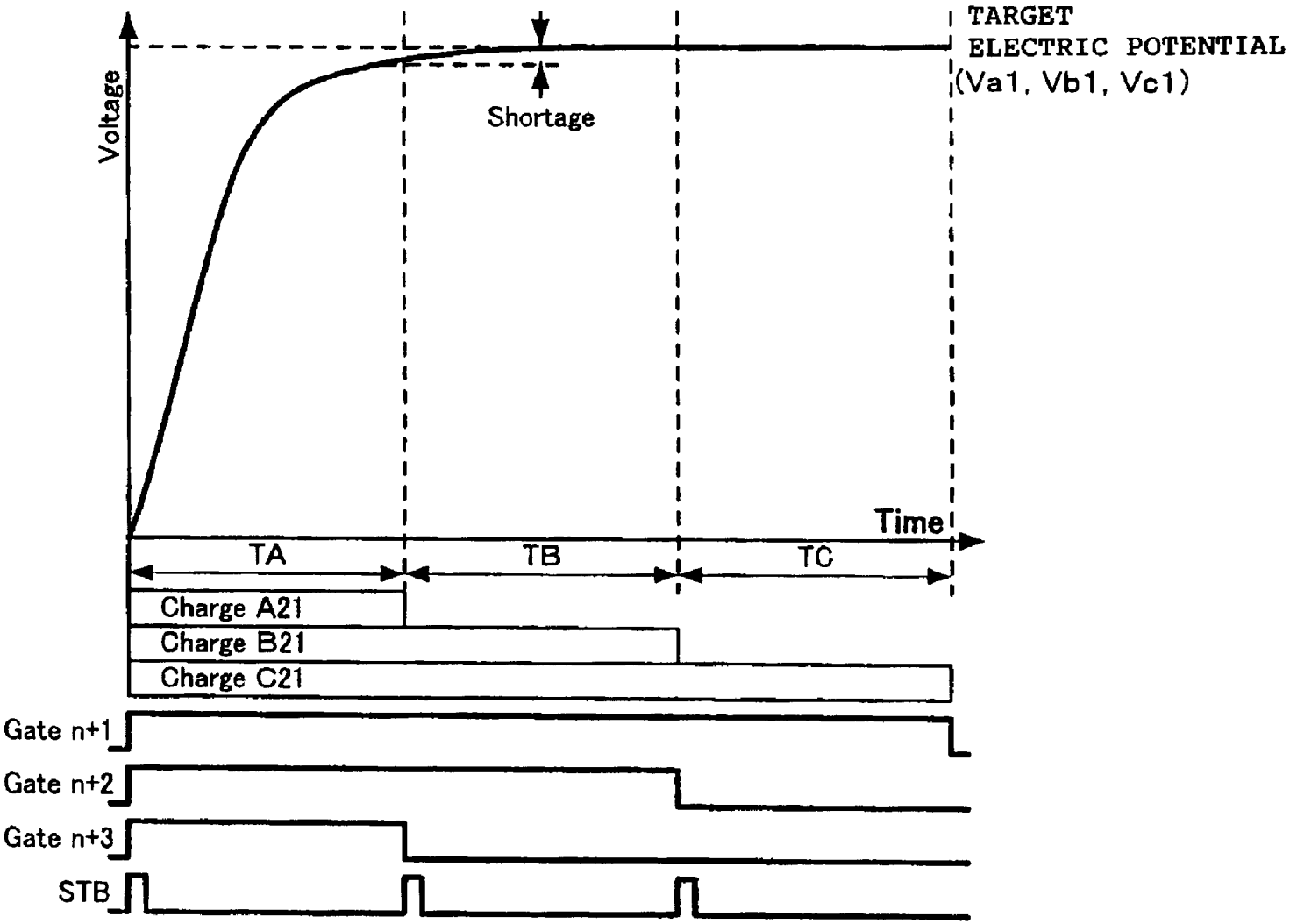
FIG. 20 is a view showing a relationship between time periods for writing electric potential and the electric potential written in pixel electrodes A21, B21, and C21, where the time periods for writing the electric potential in pixel electrode A21, B21 and C21 are all equal.
Figure 21:
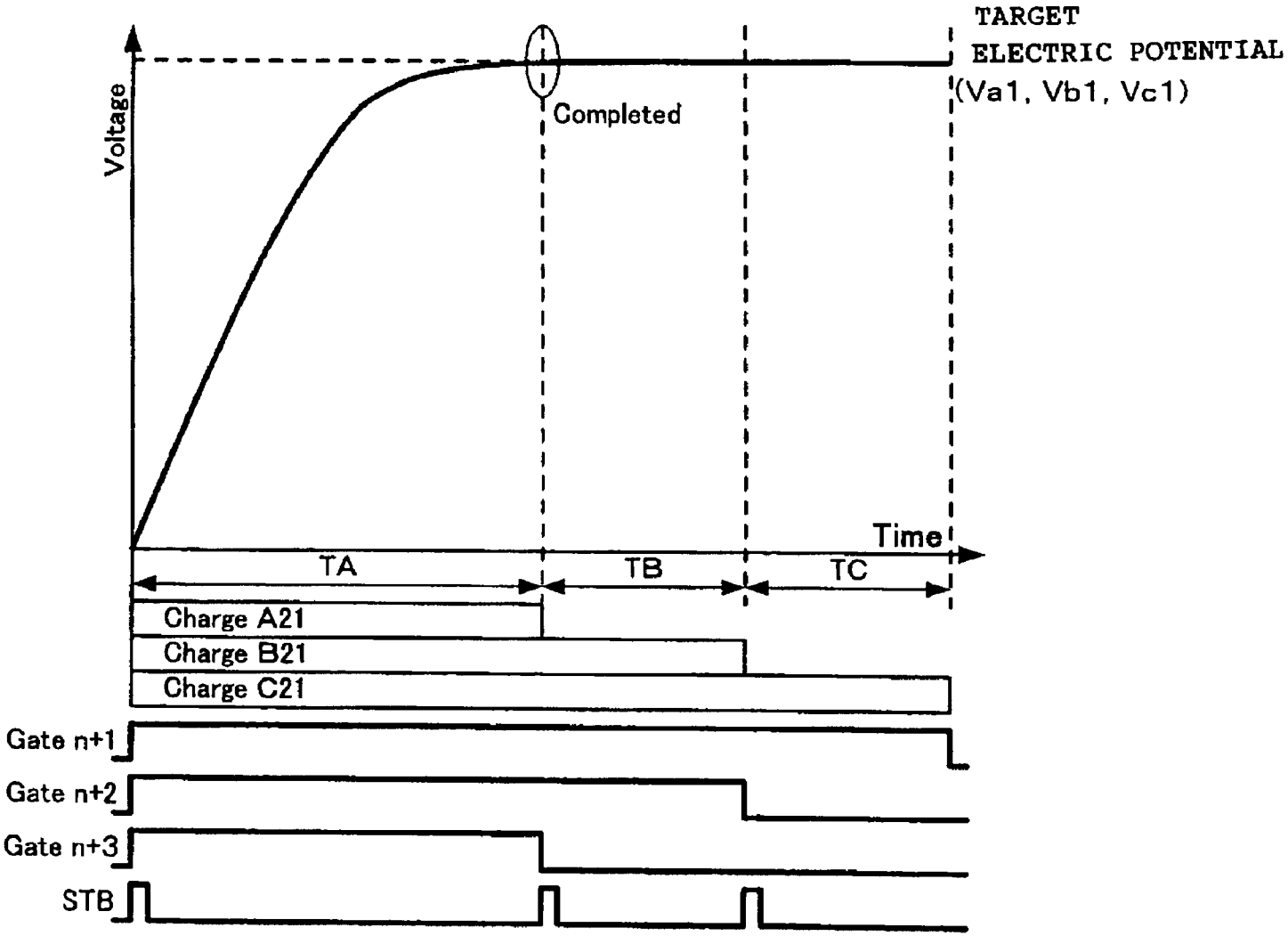
FIG. 21 is a view showing the relationship between the time periods for writing the electric potential and the electric potential written in the pixel electrodes A21, B21, and C21, where the time period for writing the electric potential in pixel electrode A21 is longer than the time period for writing the electric potential in pixel electrodes B1, and C21, in accordance with one aspect of the present invention.

As described above, according to the third embodiment, the electric potential is given to the three pixel electrodes A21 to C21 by time division within one horizontal scanning period (the H Total). Therefore, there may be a case where there is a shortage of time to write the electric potential as described previously in the first embodiment. FIG. 20 is a view for describing such a situaion, which corresponds to FIG. 9 in the first embodiment.

In FIG. 20, a time period TA for writing the electric potential to the pixel electrode A21, a time period TB for writing the electric potential to the pixel electrode B21, and a time period TC for writing the electric potential to the pixel electrode C21 are assumed to be equal (TA=TB=TC). Such writing time periods are defined by the STB. Accordingly, there may be the case where the time period for writing the electric potential to the pixel electrode A21 is in sufficient. The electric potential (Va1) is written to pixel electrode B21 during the time period for writing the electric potential to the pixel electrode A21. Meanwhile, the electric potentials Va1 and Vb1 are written to the pixel electrode C21 during the time period for writing the electric potential Va1 to the pixel electrode A21 and the time period for writing electric potential Vb1 to the pixel electrode B21. Therefore, the electric potential in the pixel electrode B21 and the pixel electrode C21 can easily reach target electric potentials. Note that the target electric potential levels among the pixel electrodes A21 to C21 are equal (Va1=Vb1=Vc1) as shown in the graph in FIG. 20 for illustrative purposes. However in practice, Va1, Vb1 and Vc1 are each set based on the desired potential to be achieved in electrodes A21, B21, and C21, respectively.

Accordingly, in the third embodiment, the time period TA for writing the electric potential in the pixel electrode A21 is set longer than the time periods for writing the electric potential in the pixel electrodes B21 and C21, with TA>TB, TA>TC. TA is set so as not to cause the shortage of writing time to the pixel electrode A21. Although TB and TC become shorter, the shortage of writing time of electric potential does not occur concerning the pixel electrodes B21 and C21, since electric potential Va1 is written to the pixel electrodes B21 and C21 in advance.

Note that adjustment of the writing time periods is executed by appropriately setting the parameters concerning the STB to be set on the parameter register 51 in a manner similar to that described in connection with the first embodiment. Moreover, upon setting the parameters, consideration should be given to effectuate sufficient saturation of writing the electric potential separately in the pixel electrode A21, B21, and C21, as described in the first embodiment.

A description has been given above of the electric potential written (pre-charged) in the both pixel electrodes B21 and C21 in advance. Nevertheless, there is also a case in the display element 2 of the third embodiment shown in FIG. 16, in which the pre-charge is not delivered to the pixel electrode B21 according to procedures for selecting the scan signal lines Gn+1, Gn+2 and Gn+3. Description will be made below regarding such an example.

In the display element 2 with the configuration shown in FIG. 16, the scan signal lines Gn+1, Gn+2, and Gn+3 are assumed to be selected in accordance with the following procedures. First, the scan signal lines Gn+1 and Gn+3 are selected but the scan signal line Gn+2 is not selected. Next, the scan signal lines Gn+1 and Gn+2 are selected and the scan signal line Gn+3 is not selected. Subsequently, the scan signal line Gn+1 is selected and the scan signal lines Gn+2 and Gn+3 are not selected. Operation of the display element 2 in the case of executing the above-mentioned selection procedures will be described based on FIG. 22 to FIG. 24.

Figure 22:
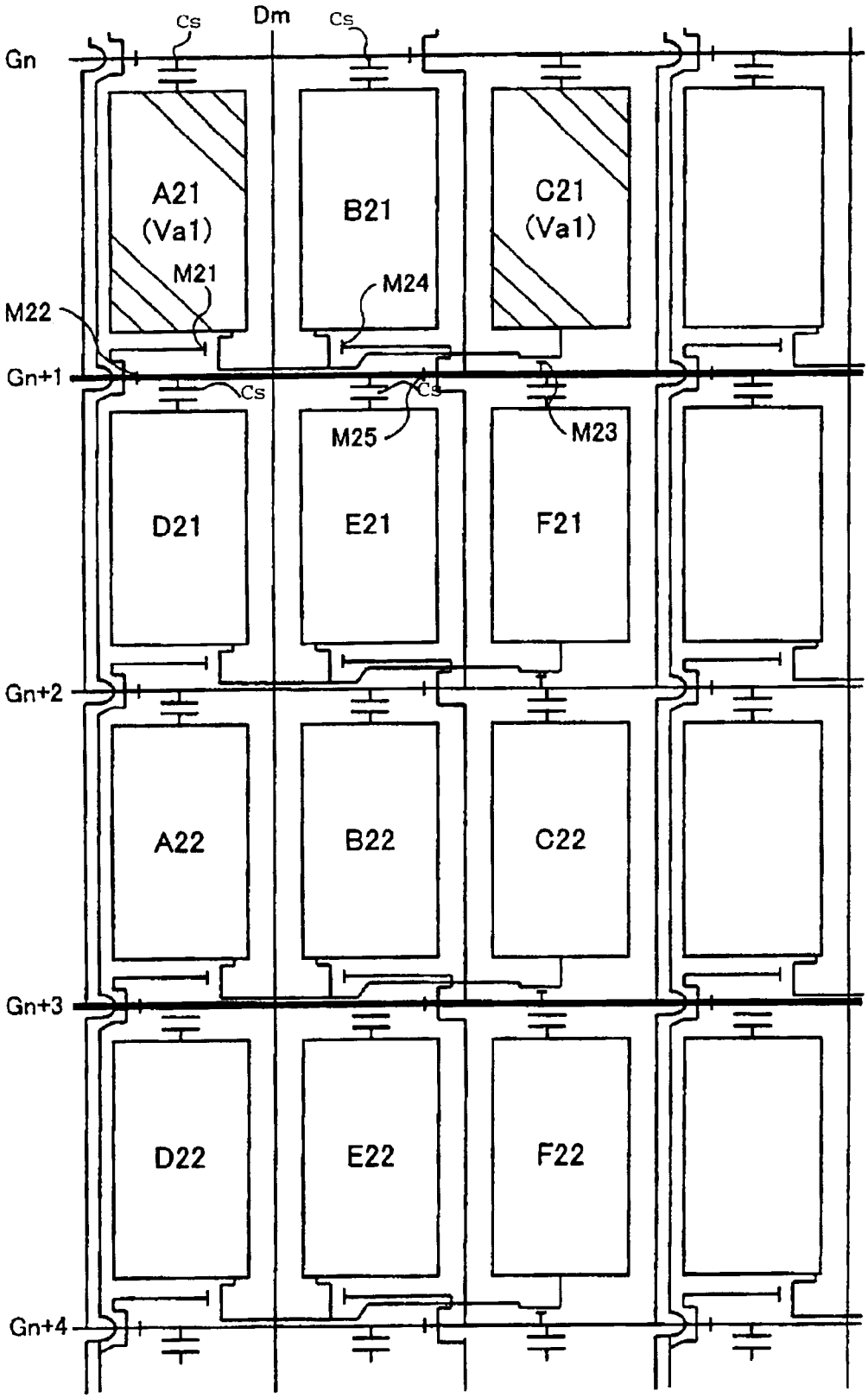
FIG. 22 is a view for explaining another example of the operation of the display element in the third embodiment.

As shown in FIG. 22, the first TFT M21 to the third TFT M23 are turned on in the state where the scan signal lines Gn+1 and Gn+3 are selected but the scan signal line Gn+2 is not selected. Therefore, as shown in FIG. 22, the electric potential Va1 to be given by the display signal line Dm to the pixel electrode A21 is written to the pixel electrode A21 and the pixel electrode C21. The electric potential Va1 for the pixel electrode A21 is determined in the event that the scan signal lines Gn+1 and Gn+2 are selected and the scan signal line Gn+3 is set to non-selection.

Figure 23:
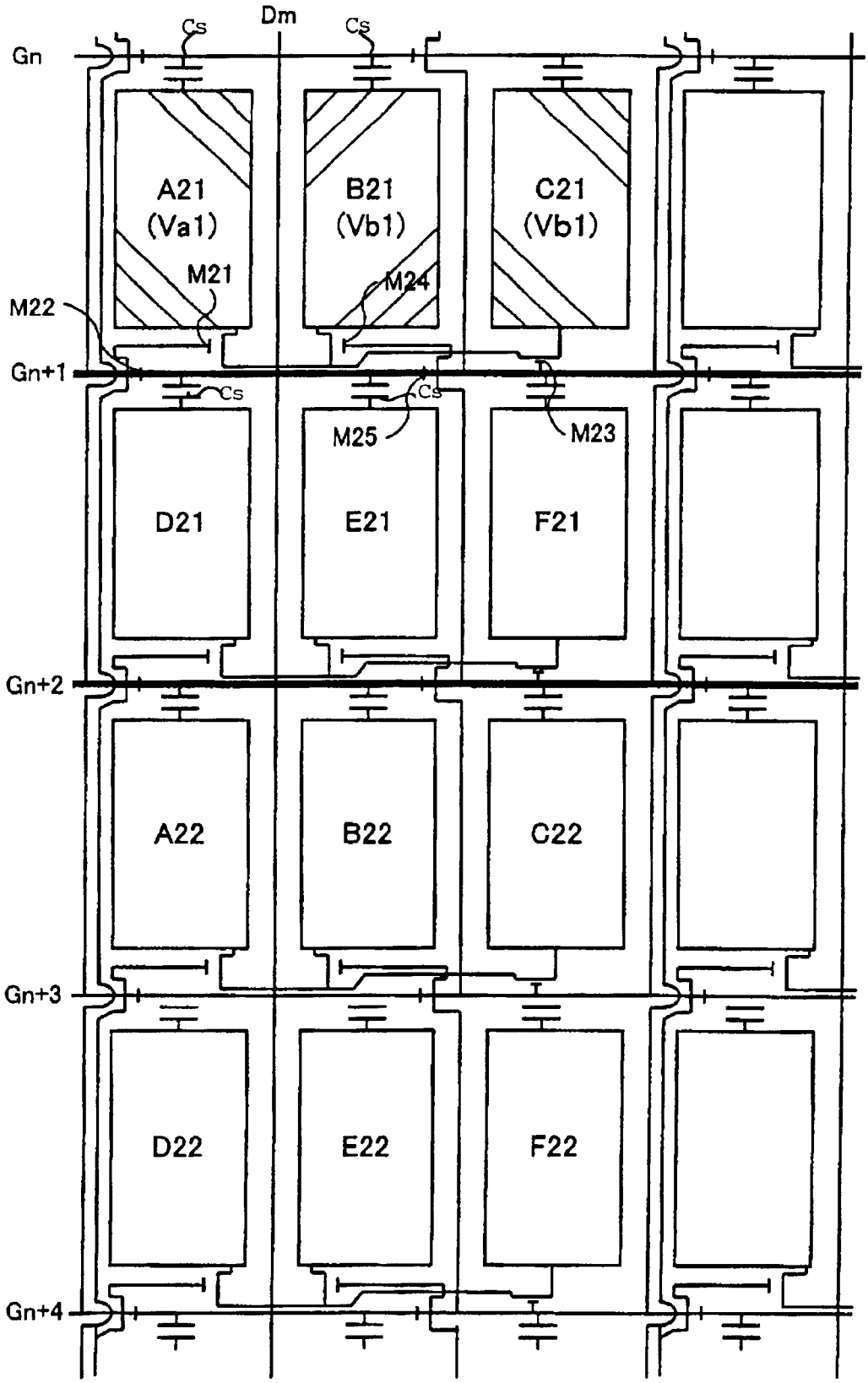
FIG. 23 is another view for explaining the operation of the display element in the third embodiment, which shows a state subsequent to the state of FIG. 22.

After the scan signal lines Gn+1 and Gn+2 are selected and the scan signal line Gn+3 is set to non-selection, the electric potential being supplied from the display signal line Dm is changed to the electric potential Vb1 to be given to the pixel electrode B21. As shown in FIG. 23, the electric potential Vb1 is supplied to the pixel electrode B21 and the pixel electrode C21 after the scan signal lines Gn+1 and Gn+2 are selected and the scan signal line Gn+3 is set to non-selection. Moreover, the electric potential Vb1 for the pixel electrode B21 is determined in the event that the scan signal line Gn+1 is selected and the scan signal lines Gn+2 and Gn+3 are set to non-selection.

Figure 24:
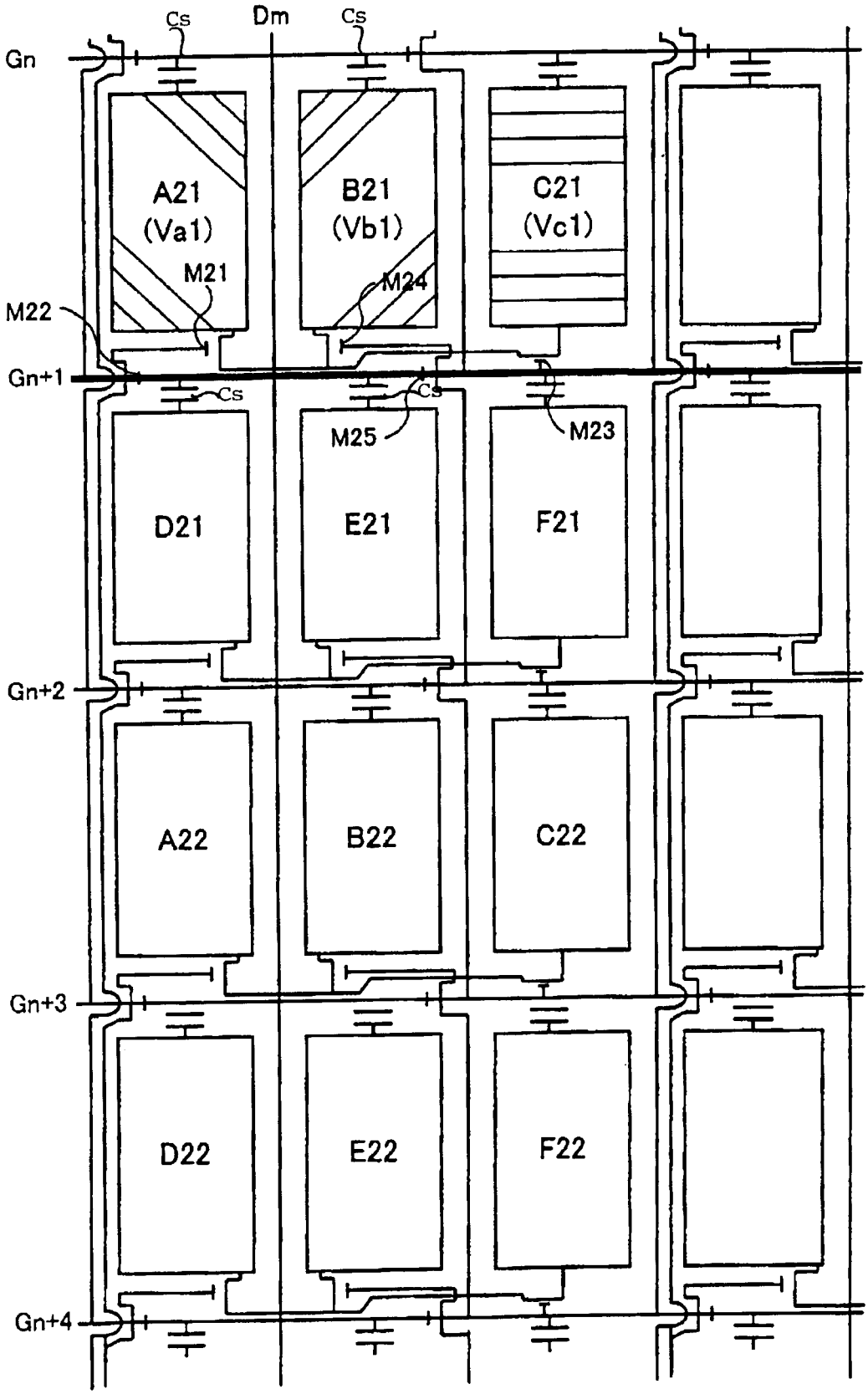
FIG. 24 is another view for explaining the operation of the display element in the third embodiment, which shows a state subsequent to FIG. 23.

After the scan signal line Gn+1 is selected and the scan signal lines Gn+2 and Gn+3 are set to non-selection, the electric potential being supplied from the display signal line Dm is changed to the electric potential Vc1 to be given to the pixel electrode C21. As shown in FIG. 24, the electric potential Vc1 is supplied to the pixel electrode C21.

Figure 25:
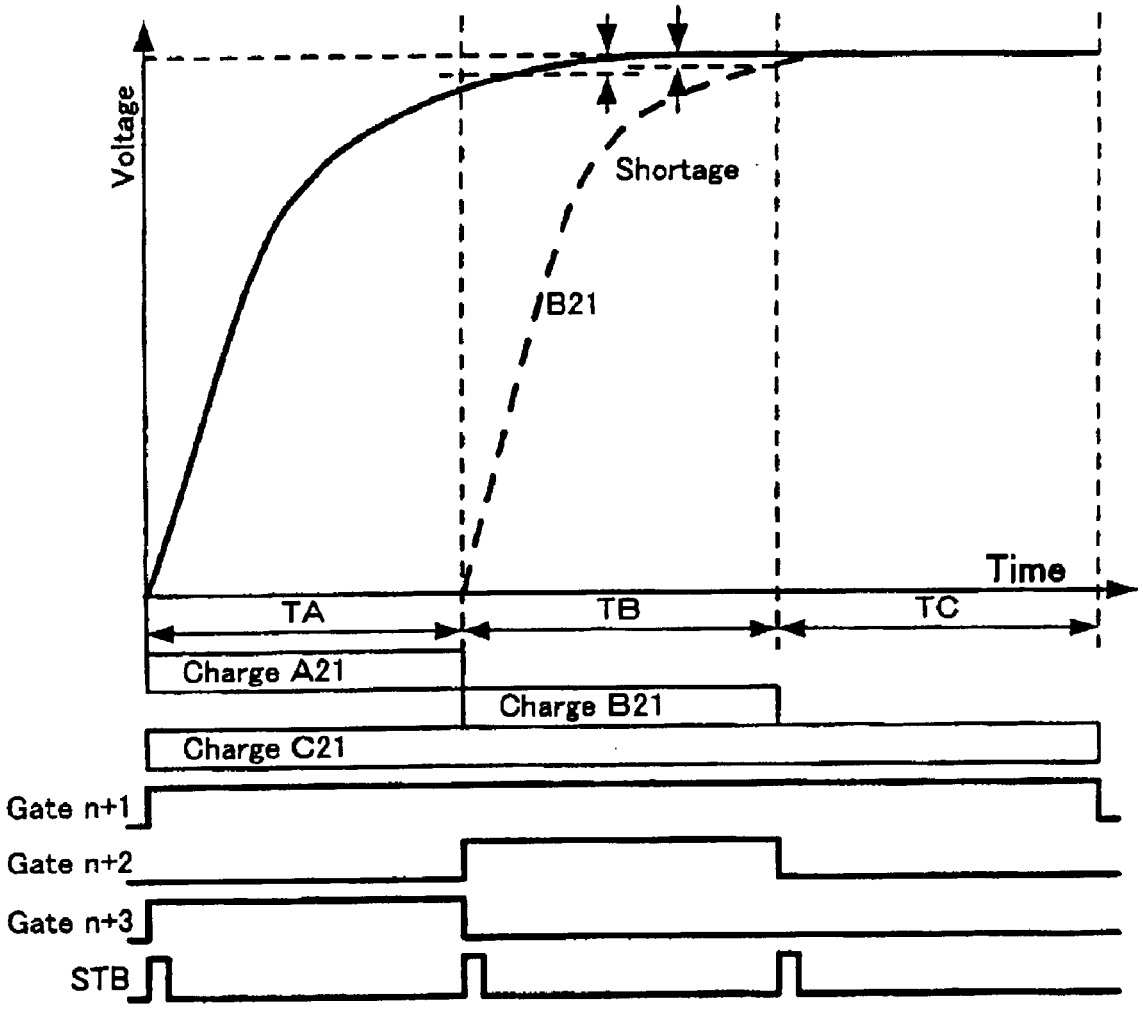
FIG. 25 is a view showing another relationship between time periods for writing electric potential and the electric potential written to the pixel electrodes A21, B21, and C21, where the time period for writing the electric potential in the pixel electrodes A21, B21, and C21 are all equal.

When the electric potential is written to the three pixel electrodes A21 to C21 by time division within one horizontal scanning period (the H Total) according to the above-described procedures, there may be a risk of causing shortage of writing of the electric potential not only in the pixel electrode A21 but also in the pixel electrode B21. FIG. 25 illustrates such a situation. Note that the time periods TA, TB, and TC for writing the electric potential in the pixel electrodes A21 to C21 are assumed to be mutually equal (TA=TB=TC) in FIG. 25 for illustrative purposes. In practice, Va1, Vb1, and Vc1 are each set based on the desired potential to be achieved in electrodes A21, B21, and C21, respectively.

In FIG. 25, the electric potential written to the pixel electrode C21 can easily reach the target electric potential because the electric potential is written therein during the time periods TA and TB. However, the electric potential for pixel electrode A21 may not reach its target electric potential because of a shortage of writing time. Similarly, the electric potential for pixel electrode B21 may not reach its target electric potential because of a shortage of writing time.

Figure 26:
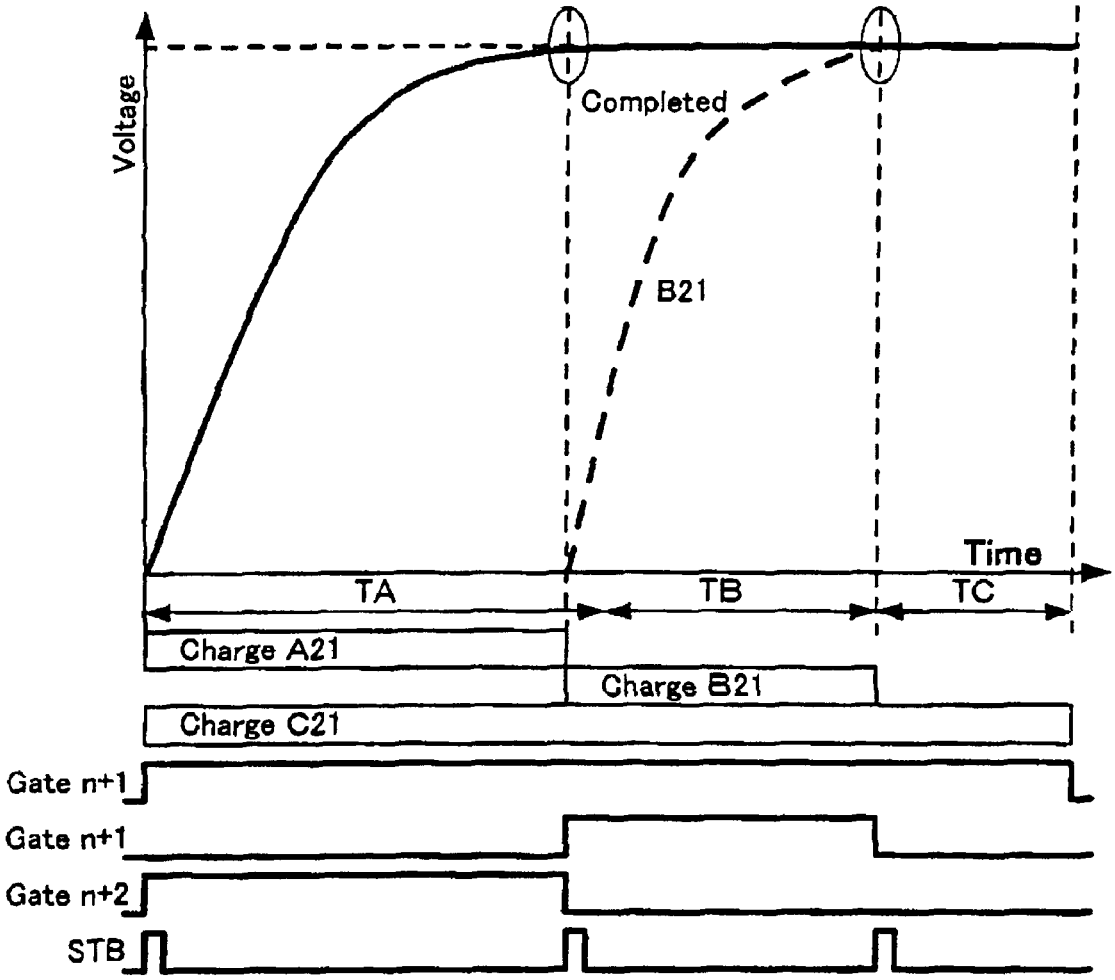
FIG. 26 is a view showing another relationship between the time periods for writing the electric potential and the electric potential written to the pixel electrodes A21, B21, and C21, where the time period for writing the electric potential to the pixel electrode A21, and the time period for writing the electric potential in the pixel electrode B21 are longer than the time period for writing the electric potential in the pixel electrode C21 in accordance with one aspect of the present invention.

Accordingly, as shown in FIG. 26 the time period TA for writing the electric potential in the pixel electrode A21 and the time period TB for writing the electric potential in the pixel electrode B21 are set longer than the time period for writing the electric potential in the pixel electrode C21 TA>TC, TB>TC. In this way, it is possible to solve the shortage of writing time to the pixel electrode A21 and the pixel electrode B21. Although the time period TC for writing the electric potential to the pixel electrode C21 becomes shorter, a shortage of writing time does not occur concerning the pixel electrode C21 because the pixel electrode C21 is pre-charged.

As described above, in the liquid crystal display device 1 in which the three pixel electrodes A21 to C21 are connected to the single display signal line Dm, it is also possible to avoid the shortage of writing time of electric potential to the respective pixel electrodes A21 to C21 by means of adjusting the time periods for writing the electric potential in the three pixel electrodes A21 to C21.

Fourth Embodiment

In the above-described second embodiment, the liquid crystal display device 1 changes the parameters concerning the STB independently. However, such a change of the parameters can be executed by the system 6 connected to the liquid crystal display device 1. Such a mode has an advantage that the system 6 can provide the optimum driving parameters because the system 6 recognizes the display mode in the first place. Therefore, the liquid crystal display device 1 does not have to measure the H Total as in the second embodiment. For this reason, the H counter 53 and the translator 54 as shown in the second embodiment are not required herein. Instead, the system 6 has to obtain information regarding the liquid crystal display device 1 in order to set and change the parameters.

Figure 27:
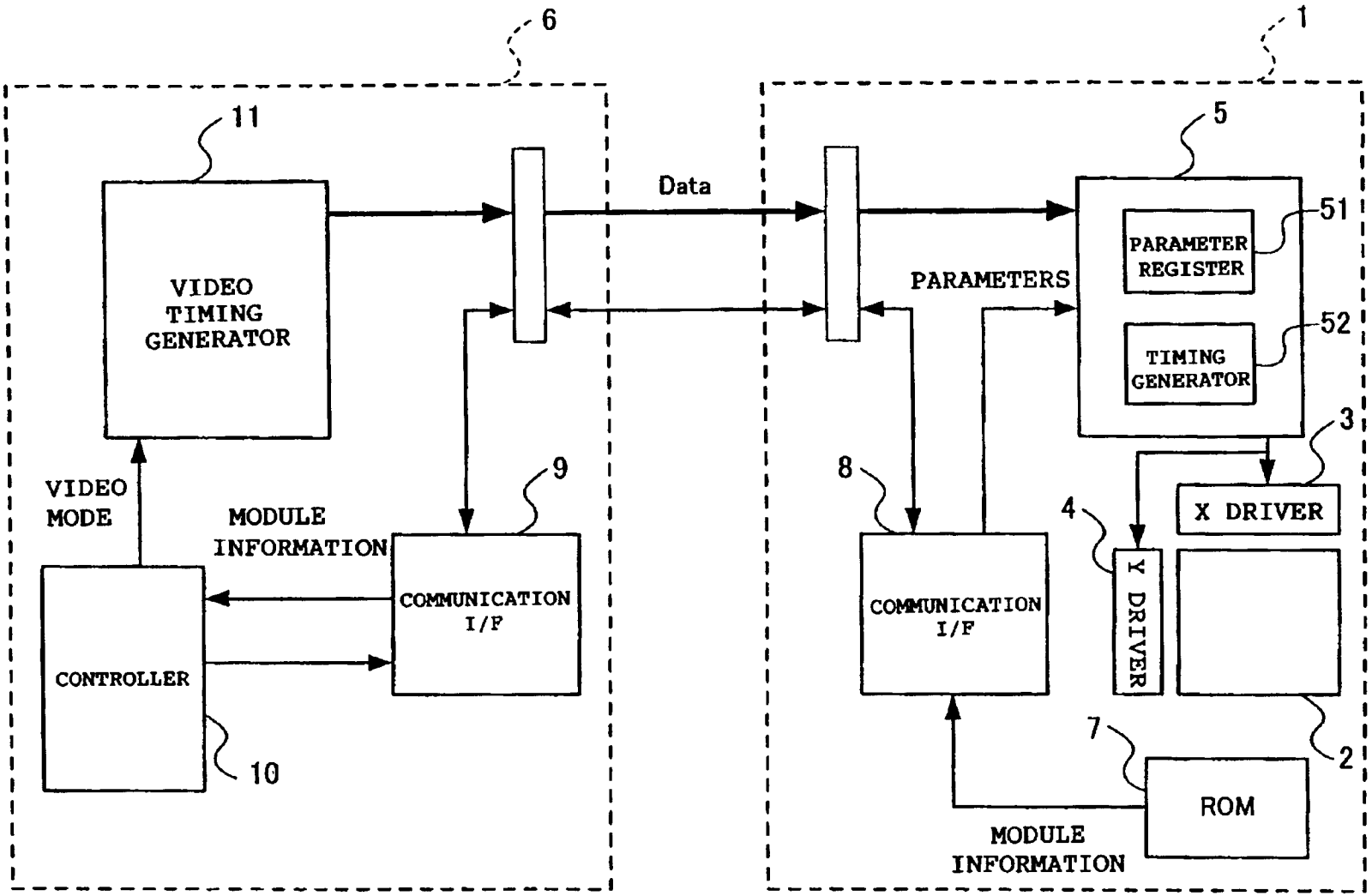
FIG. 27 is a block diagram showing configurations of a system and a liquid crystal display device according to a fourth embodiment.

FIG. 27 is a block diagram showing a configuration for effectuating a change of the parameters concerning the STB by the system 6 outside the liquid crystal display device 1. In FIG. 27, the same reference numerals are affixed to the same elements as those in FIG. 1.

The liquid crystal display device 1 includes a ROM 7 for storing the information regarding the liquid crystal display device 1. The information (module information) regarding the liquid crystal display device 1 stored in ROM 7, such as information required for setting the parameters including part numbers and the like, is transferred to the system 6 via a communication interface (I/F) 8. System 6 receives the information thus transferred with a controller 10 via a communication interface (I/F) 9.

The controller 10 provides a video timing generator 11 with a video mode. The video mode contains information regarding H Total. The controller 10 sets up the parameters concerning the STB based on H Total and the received module information. The parameters concerning the STB thus set up are outputted from the controller 10 to the liquid crystal display device 1 via the communication interface (I/F) 9. The controller 10 sets up the parameters concerning the STB every time H Total is changed.

The video timing generator 11 outputs the video data to the liquid crystal display device 1 based on the received video mode.

The liquid crystal display device 1 receives the digital video data outputted from system 6 with timing controller 5. The liquid crystal display device 1 also receives the parameters concerning the STB, which are outputted from the system 6, with the timing controller 5 via the communication interface (I/F) 8. The timing controller 5 stores the received parameters concerning the STB in the parameter register 51. The timing generator 52 controls driving of x driver 3 and y driver 4 based on the parameters stored in the parameter register 51 and on the received digital video data. For details of such control operations, details as described in any one of the first to the third embodiments are applicable thereto.

As described above, according to the present invention, it is possible to provide a method of supplying writing electric potential suitable for an active-matrix display device to one display signal line for two or more adjacent pixels by time division. To be more precise, the present invention can solve a shortage of writing time with respect to the two or more pixels.

Although the preferred embodiments of the present invention have been described in detail, it should be understood that various changes, substitutions, and alternations can be made therein without departing from spirit and scope of the invention as defined by the appended claims.

What is claimed is:

1. An image display device comprising:

a display signal line for transmitting display signals;

first and second switching elements;

first and second pixel electrodes coupled to said display signal line through said first and second switching elements for receiving display signals;

a scan signal line for transmitting scan signals for controlling said first and second switching elements; and signal processing means for generating first and second display signals, said first and second display signals associated with said first and second pixel electrodes, respectively, said signal processing means also generating the scan signals for causing said display signals to be provided to said first and second switching elements in a time division manner within one horizontal scanning period HT, said signal processing means setting up a time period TA for writing the first display signal and a time period TB for writing the second display signal so as to satisfy an inequality TA is greater than TB, wherein the given horizontal scanning period HT satisfied an equality represented as HT=HD+HB, in which HD is a time period when any one of the first and second signals is inputted and the HB is a time period when the first and second signals are not inputted, and the signal processing means sets TB to HD/2 or below.

2. The image display device according to claim 1, wherein the first display signal is written to the second pixel electrode during the time period TA when the first display signal is also written to the first pixel electrode.

3. The image display device according to claim 2, wherein the signal processing means sets HT, TA, and TB to satisfy the equation HT is greater than or equal to TA plus TB.

4. The image display device according to claim 1, wherein the signal processing means resets at least one of TA and TB so that TA is greater than TB when the horizontal scanning period is changed.

5. The image display device according to claim 1, wherein the signal processing means sets HT, TA, and TB to satisfy the equation HT is greater than or equal to TA plus TB.

6. The image display device according to claim 1, wherein the first and second pixel electrodes are driven to the same polarity during the one horizontal scanning period.

7. An image display device comprising:

an image display element provided with a plurality of pixel electrodes arranged in the form of a matrix, common display signal lines for transmitting electric potential to two or more pixel electrodes and scan signal lines for transmitting scan signals to said two or more pixel electrodes including a targeted pixel electrode in which electric potential is to be written to first and non-targeted pixel electrodes in which electric potential is to be written to subsequently; and signal processing means for generating and supplying electric potential to the display signal lines, the signal processing means setting, during a given horizontal scanning period HT, a time period for writing electric potential in to the targeted pixel electrodes that is longer than the time period for writing to non-targeted pixel electrodes, wherein the given horizontal scanning period HT satisfies an equality represented as HT=HD+HB, in which HD is a time period in which electric potential is to be written to any one of the first and non-targeted pixel electrodes and HB is a time period in which electric potential is not to be written to any one of the first and non-targeted pixel electrodes, and the signal processing means sets the time period for writing to non-targeted pixel electrodes to HD/2 or below.

8. The image display device according to claim 7, wherein two of the pixel electrodes are connected to the common display signal line and the electric potential is written to the non-targeted pixel electrode during the time period when the electric potential is written to targeted pixel electrode, pro-charging the non-targeted pixel electrode.

9. The image display device according to claim 7, wherein three pixel electrodes are connected to the common display signal line and the electric potential is written to non-targeted pixel electrodes during the time period when the electric potential is written to targeted pixel electrode pre-charging the non-targeted pixel electrodes.

10. The image display device according to claim 7, wherein the time period for writing the electric potential in the targeted pixel electrode and the time periods for writing in non-targeted pixel electrodes are separately set to achieve desired electric potential of the targeted and non-targeted pixel electrodes.

11. A display signal supplying device for supplying writing electric potential to an active-matrix image display element, comprising:

signal supplying means for supplying writing electric potential relevant to a plurality of pixels that include a given pixel and another pixel to a given display signal line in one horizontal scanning period HT by time division; and writing time changing means for changing a time period or supplying the writing electric potential to at least one of the plurality of pixels, wherein the one horizontal scanning period HT satisfies an equality represented as HT=HD+HB, in which HD is a time period when the writing electric potential relevant to a plurality of pixels is supplied and the HB is a time period when writing electric potential relevant to a plurality of pixels is not supplied, and the signal supplying means sets a time period for supplying the writing electric potential to the another pixel to HD/2 or below.

12. The display signal supplying device according to claim 11, wherein the writing time changing means changes the time period for supplying the writing electric potential based on a change of the one horizontal scanning period.

13. The display signal supplying device according to claim 11, wherein the time period for supplying the writing electric potential to the given pixel out of the plurality of pixels is set to be longer than the time period for supplying the writing electric potential to the another pixel.

14. The display signal supplying device according to claim 13, wherein the signal supplying means gives priority to the supply of the writing electric potential to the given pixel over the supply of the writing electric potential to the other pixel.

15. A method of supplying writing electric potential to an active-matrix image display element, comprising the steps of:

generating writing electric potential relevant to a plurality of pixels in one horizontal scanning period HT based on video data; and setting a time period for supplying the writing electric potential to a given pixel out of the plurality of pixels to be longer than a time period for supplying the writing electric potential to another pixel, wherein the one horizontal scanning period HT satisfies an equality represented as HT=HD+HB, in which HD is a time period when the writing electric potential is supplied to any one of the plurality of pixels and the HB is a time period when the writing electric potential is not supplied to any one of the plurality of pixels, and the time period for supplying the writing electric potential to another pixel is HD/2 or below.

16. The method of supplying writing electric potential according to claim 15, wherein the writing electric potential is supplied to the plurality of pixels from a common display signal line by time division.

17. A method of supplying writing electric potential to an active-matrix image display element, comprising the steps of:

receiving video data relevant to a plurality of pixels;

generating writing electric potential relevant to the plurality of pixels based on the video data; and supplying the writing electric potential to the plurality of pixels in one horizontal scanning period HT by time division, wherein a time period for supplying the writing electric potential to each of the plurality of pixels is dynamically set up based on the one horizontal scanning period, and wherein the one horizontal scanning period HT satisfies an equality represented as HT=HD+HB, in which HD is a time period when the writing electric potential is supplied to at least one of the plurality of pixels and the HB is a time period when the writing electric potential is not supplied to at least one of the plurality of pixels, and a time period for supplying the writing electric potential to a non-targeted pixel is HD/2 or below.

18. The method of supplying writing electric potential according to claim 17, wherein the time period for supplying the writing electric potential to each of the plurality of pixels is changed separately in accordance with a change of the one horizontal scanning period.

19. A method of supplying writing potential to an image display device, comprising the steps of:

during a horizontal scan period HT, supplying an electric potential to a plurality of pixel electrodes on a common display line for achieving the desired potential of a targeted pixel electrode of the plurality of pixel electrodes and for pre-charging the rest of the plurality of pixel electrodes; and subsequently during the same horizontal scan period, supplying an electric potential to one of the pre-charged pixel electrodes to achieve the desired potential in the pre-charged pixel electrode, the time period during which the electric potential is supplied to the pre-charged pixel electrode for achieving the desired potential in the pre-channel pixel electrode being less than the time period electric potential is supplied to a target pixel electrode to achieve the desired potential of the target pixel electrode, wherein the horizontal scan period HT satisfies an equality represented as HT=HD+HB in which HD is a time period during which the electric potential as supplied to at least one of the plurality of pixel electrodes and the HB is a time period during which the electric potential is not supplied to at least one of the plurality of pixel electrodes, and the time period during which the electric potential is supplied to the pre-charged pixel electrode is HD/2 or below.

* * * * *